US009104142B2

(12) United States Patent
Kubo et al.

(10) Patent No.: US 9,104,142 B2
(45) Date of Patent: Aug. 11, 2015

(54) DEVELOPING DEVICE AND IMAGE FORMING APPARATUS

(71) Applicant: CANON KABUSHIKI KAISHA, Tokyo (JP)

(72) Inventors: Kenta Kubo, Kamakura (JP); Tatsuya Tada, Yokohama (JP); Satoru Yamanaka, Kawasaki (JP); Hideaki Okamoto, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/097,635

(22) Filed: Dec. 5, 2013

(65) Prior Publication Data

US 2014/0161493 A1 Jun. 12, 2014

(30) Foreign Application Priority Data

Dec. 11, 2012 (JP) ..... 2012-270394

(51) Int. Cl.
*G03G 15/09* (2006.01)
*G03G 15/08* (2006.01)

(52) U.S. Cl.
CPC ..... *G03G 15/0921* (2013.01); *G03G 15/0818* (2013.01); *G03G 15/09* (2013.01)

(58) Field of Classification Search
CPC G03G 15/0921; G03G 15/0918; G03G 15/09
USPC ..... 399/272, 274, 276, 277
See application file for complete search history.

(56) References Cited

U.S. PATENT DOCUMENTS

| | | | | |
|---|---|---|---|---|
| 4,786,936 | A | 11/1988 | Ikegawa et al. | |
| 5,517,286 | A | 5/1996 | Tada et al. | |
| 5,523,533 | A | 6/1996 | Itoh et al. | |
| 5,781,836 | A | 7/1998 | Tada et al. | |
| RE38,026 | E | 3/2003 | Tada et al. | |
| 7,471,909 | B2 | 12/2008 | Haraguchi et al. | |
| 7,912,389 | B2 | 3/2011 | Yamamoto et al. | |
| 8,326,165 | B2 | 12/2012 | Kubo et al. | |
| 2008/0247771 | A1 * | 10/2008 | Fujita et al. | 399/53 |

FOREIGN PATENT DOCUMENTS

| | | | |
|---|---|---|---|
| JP | 60-042776 | A | 3/1985 |
| JP | 63-101879 | A | 5/1988 |
| JP | 08-012510 | B2 | 2/1996 |
| JP | 08-137243 | A | 5/1996 |
| JP | 10-198161 | A | 7/1998 |
| JP | 2002-341633 | A | 11/2002 |
| JP | 2005-121795 | A | 5/2005 |
| JP | 2008-122707 | A | 5/2008 |
| JP | 2009-008834 | A | 1/2009 |
| JP | 2011-075803 | A | 4/2011 |
| JP | 4949807 | B2 | 6/2012 |

* cited by examiner

*Primary Examiner* — Ryan Walsh
(74) *Attorney, Agent, or Firm* — Fitzpatrick, Cella, Harper & Scinto

(57) ABSTRACT

The developing device includes a developing container that stores a developer including a non-magnetic toner and a magnetic carrier, a toner bearing member that bears the toner and conveys the toner to a developing portion and a separating portion wherein a surface of the toner bearing member includes a plurality of recess structures. A percentage of the recess structures per unit area in a toner bearing region of the toner bearing member is equal to or larger than 55%.

9 Claims, 28 Drawing Sheets

$$F = \sum \alpha \cdot \left( \frac{q(n)}{a(n)} \right)^2$$

$$= \alpha \cdot \left\{ \left( \frac{q_A}{a} \right)^2 + \left( \frac{q_B}{a+r} \right)^2 \right\} \cong f(q_A)$$

$$\cdot Fm = \sum \beta \cdot \left( \frac{q(n)}{b(n)} \right)^2$$

$$= \beta \cdot \left\{ \left( \frac{q_B}{b} \right)^2 + \left( \frac{q_A}{b+r} \right)^2 \right\} \cong m(q_B)$$

FIG. 10A
| | POSITIVE-POLARITY TONER | NEGATIVE-POLARITY TONER |
|---|---|---|
| CARRIER A | × | ○ |
| CARRIER B | × | × |
| CARRIER C | ○ | × |
FIG. 10B
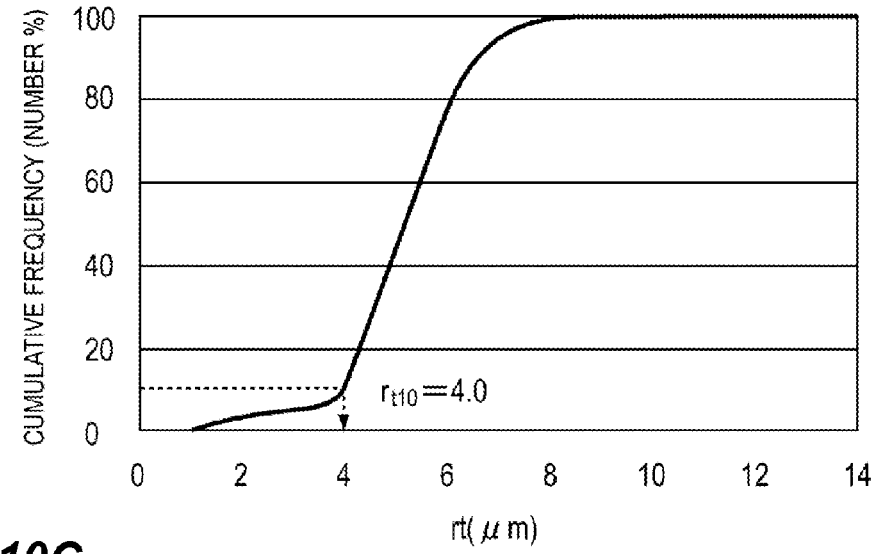
FIG. 10C
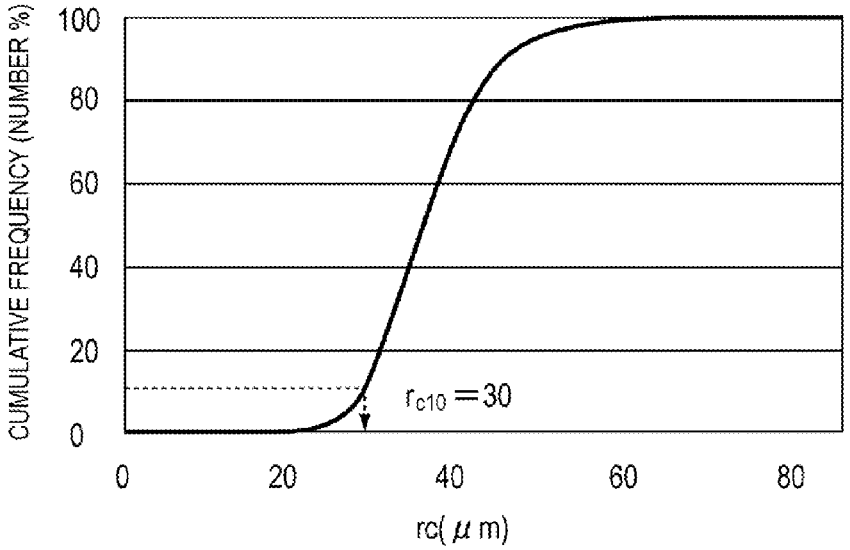

| | R=1.0 | R=4.0 | R=8.0 | R=12 | R=16 | R=20 | R=25 | R=30 | R=35 |
|---|---|---|---|---|---|---|---|---|---|
| D=1.0 | × | × | × | × | × | × | × | × | × |
| D=2.0 | × | ○ | ○ | ○ | ○ | ○ | ○ | ○ | × |
| D=3.0 | × | ○ | ○ | ○ | ○ | ○ | ○ | ○ | × |
| D=4.0 | × | ○ | ○ | ○ | ○ | ○ | ○ | ○ | × |
| D=5.0 | × | ○ | ○ | ○ | ○ | ○ | ○ | ○ | × |

| | R=1.0 | R=3.0 | R=5.0 | R=7.0 | R=10 | R=15 | R=20 | R=25 | R=30 | R=35 |
|---|---|---|---|---|---|---|---|---|---|---|
| D=0.5 | × | × | × | × | × | × | × | × | × | × |
| D=1.5 | × | ○ | ○ | ○ | ○ | ○ | ○ | ○ | ○ | × |
| D=2.5 | × | ○ | ○ | ○ | ○ | ○ | ○ | ○ | ○ | × |
| D=3.5 | × | ○ | ○ | ○ | ○ | ○ | ○ | ○ | ○ | × |
| D=4.5 | × | ○ | ○ | ○ | ○ | ○ | ○ | ○ | ○ | × |

*FIG. 12A*
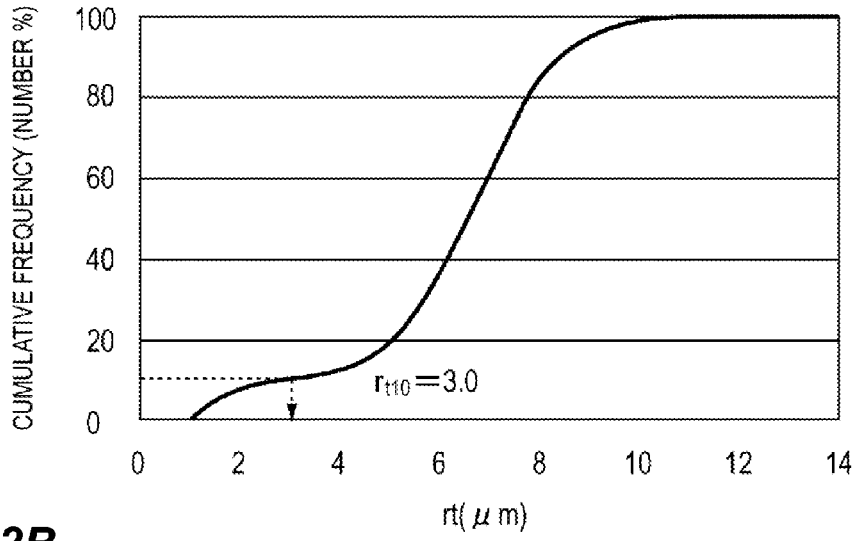
*FIG. 12B*
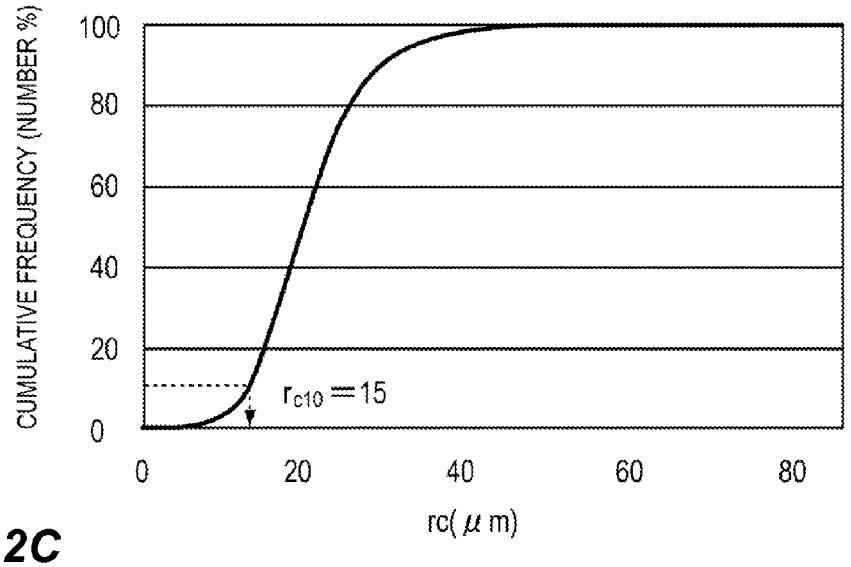
*FIG. 12C*
| | R=1.0 | R=3.0 | R=5.0 | R=7.0 | R=10 | R=15 | R=20 | R=25 | R=30 | R=35 |
|---|---|---|---|---|---|---|---|---|---|---|
| D=0.5 | × | × | × | × | × | × | × | × | × | × |
| D=1.5 | × | ○ | ○ | ○ | ○ | ○ | × | × | × | × |
| D=2.5 | × | ○ | ○ | ○ | ○ | ○ | × | × | × | × |
| D=3.5 | × | ○ | ○ | ○ | ○ | ○ | × | × | × | × |
| D=4.5 | × | ○ | ○ | ○ | ○ | ○ | × | × | × | × |

FIG. 13A

$$\frac{m}{s} \propto \frac{S_{Dn}}{S_{Tn}}$$

FIG. 13B

$$Dr \propto \int G(x)dx$$

FIG. 13C

$$\frac{S_{Dn} \cdot \kappa}{\rho} \geq S_{Tn} \cdot d_t$$

$S_{Dn}$: AREA OF REGION Dn ($cm^2$)

$S_{Tn}$: AREA OF TRIANGLE Tn ($cm^2$)

ρ: TRUE TONER WEIGHT g/c m3, $d_t$: TONER LAYER THICKNESS AFTER FIXING (cm)

κ: TONER LOAD AMOUNT IN RECESS STRUCTURE ($g/cm^2$)

FIG. 13D

$$\kappa = \frac{\pi \cdot \rho \cdot r_t}{3\sqrt{3}} \times 10^{-4}$$

FIG. 13E

$$\frac{S_{Dn}}{S_{Tn}} \geq 0.55$$

*FIG. 13F*

$$S_{Dn} = \pi r^2 / 2$$

*FIG. 13G*

$$S_{Tn} = \frac{\sqrt{3}}{4}(2r + S)^2$$

*FIG. 13H*

$$\frac{S_{Dn}}{S_{Tn}} = \frac{2\pi}{\sqrt{3}}\left(\frac{1}{2 + S/r}\right)^2$$

*FIG. 13I*

$$\frac{S_{Dn}}{S_{Tn}} \leq \frac{2\pi}{\sqrt{3}}\left(\frac{1}{2 + r_{t10}/8r_{c10}}\right)^2$$

*FIG. 16A*

| λ (μm) | 7.5 | 8.5 | 10.0 | 11.5 | 12.5 |
|---|---|---|---|---|---|
| ∫ G(x)dx | 99 | 77 | 55 | 42 | 36 |
| DENSITY EVALUATION | ○ | ○ | ○ | × | × |
| Δ ( ∫ G(x)dx) | 0 | 0 | 0 | 0 | 0 |
| UNIFORMITY EVALUATION | ○ | ○ | ○ | ○ | ○ |

*FIG. 16B*

| λ (μm) | 32.5 | 35 | 40 | 45 | 50 |
|---|---|---|---|---|---|
| ∫ G(x)dx | 99 | 92 | 70 | 55 | 45 |
| DENSITY EVALUATION | ○ | ○ | ○ | ○ | × |
| Δ ( ∫ G(x)dx) | 0 | 0 | 0 | 0 | 0 |
| UNIFORMITY EVALUATION | ○ | ○ | ○ | ○ | ○ |

*FIG. 19A*

$$\int G(x)dx \approx \sum g(n)$$

*FIG. 19B*

$$\Delta\left(\int G(x)dx\right) = \pm \frac{\int G_{max}(x) - \left(\frac{\int G_{max}(x) + \int G_{min}(x)}{2}\right)}{\frac{\int G_{max}(x) + \int G_{min}(x)}{2}} \times 100 \quad (\%)$$

*FIG. 22A*

$$\frac{S_{Dn}}{S_{Tn}} \geq 0.55$$

*FIG. 22B*

$$\frac{S_{Dn}}{S_{Tn}} = \frac{L}{L+S} \geq 0.55$$

*FIG. 22C*

$$\frac{r_{c10}}{r_{t10}/8 + r_{c10}} \geq \frac{S_{Dn}}{S_{Tn}} \geq 0.55$$

DEVELOPING DEVICE AND IMAGE FORMING APPARATUS

BACKGROUND OF THE INVENTION

1. Field of the Invention

The present invention relates to an image forming apparatus which uses an electrophotographic system such as a copying machine, a printer, or a facsimile and a developing device used therein.

2. Description of the Related Art

As a dry developing method applied to the electrophotographic system, a single-component developing method that uses toner only and a two-component developing method that uses a developer composed of toner and a magnetic carrier are known.

Since the single-component developing method does not use a magnetic carrier, an electrostatic latent image on an image bearing member may not be disturbed by a magnetic brush formed by the magnetic carrier and this method is thus ideal for obtaining high image quality. However, the single-component developing method has a difficulty in stably charging the toner and has a problem in providing stable image quality. Moreover, since this method does not have a medium like a magnetic carrier that conveys the toner, it is difficult to apply uniform conveying force to the toner and the load to the toner is likely to increase. Due to this, deterioration of toner can lead to a decrease in the ability to provide stable image quality. On the other hand, the two-component developing method has a problem in providing high image quality, it is easy to charge the toner and the load to the toner is small, therefore providing highly stable image quality.

In order to solve the problems of both developing methods, a hybrid developing method of applying a conveying bias between a developing roller that bears a two-component developer and a toner bearing member to coat a toner layer on the toner bearing member and developing an electrostatic latent image on an image bearing member with toner to form an image is known.

However, it is known that the hybrid developing method has a difficulty in coating the toner layer stably on the toner bearing member for a long period. This is based on the following reasons.

In the hybrid developing method, toner having a predetermined charge amount (Q/S) is coated on the toner bearing member so as to counteract a potential difference ΔV between the developing roller and the toner bearing member, generated by the conveying bias.

$$\Delta V \propto Q/S = M/S \times Q/M$$

That is, in the hybrid developing method, the amount of coat (M/S) is determined based on the potential difference (ΔV) and the toner charge amount (Q/M). Thus, the amount of coat of toner changes by changing the charging amount of the toner.

In order to solve the problem, the following techniques are known. First, when a toner layer is coated on a toner bearing member, the thickness of the toner layer on the toner bearing member is measured using a toner layer thickness detecting unit. Moreover, a conveying bias between the toner bearing member and the developing roller and a rotation speed of the toner bearing member and the developing roller are changed based on the toner layer thickness, the thickness of the toner layer on the toner bearing member may be controlled to a predetermined thickness (for example, see Japanese Patent Laid-Open No. 2009-008834).

However, since this method uses a toner density sensor or a surface potential sensor as the toner layer thickness detecting unit, the size of the device and associated cost may increase. Moreover, even when the thickness is controlled using the detecting unit, if the conveying bias and the rotation speed of the toner bearing member are changed, it is also necessary to control the conditions of developing between the toner bearing member and the image bearing member on the downstream side at the same time. Due to this, there is a problem that the control is complex and it is difficult to attain an original object and stabilize the amount of toner on the image bearing member.

Thus, a developing method of coating a toner layer stably is proposed (for example, see Japanese Patent Laid-Open No. 60-042776). This method uses a two-component developer composed of a non-magnetic toner and a magnetic carrier where the magnetic carrier is regulated by a magnetic field confined within the developing container. In this manner, it is possible to coat a toner layer on a toner bearing member.

Moreover, a technique of coating a toner layer on a toner bearing member using a rotatable developer regulating member so that the toner is stably charged with a carrier without decreasing the density of an output image and causing the toner to be scattered is disclosed (for example, see Japanese Patent Laid-Open No. 10-198161).

An example of a developing device using this developing method will be described with reference to FIGS. 26A and 26B. FIGS. 26A and 26B are diagrams illustrating a schematic configuration of a developing device of the related art.

A developing device 120 of this example includes a developing container 121 that stores a developer composed of toner and a magnetic carrier. A developing roller 142 that is rotatable in the direction indicated by an arrow in the drawings and a regulating sleeve 143 as a developer regulating member disposed at a predetermined distance above the developing roller 142 are disposed in an opening of the developing container 121 formed at such a position that it faces the image bearing member 101.

The regulating sleeve 143 is formed of a non-magnetic member and is arranged so as to be rotatable in the same direction as the rotation direction of the developing roller 142, and a permanent magnet 144 is fixedly disposed inside the regulating sleeve 143.

Further, a conveying member 126 that rotates in the direction indicated by the arrows in the drawings mix the developer in the developing container 121 and supply the developer to the developing roller 142 in the developing container 121.

Coating of a toner layer on the developing roller 142 in the developing device 120 will be described. The developer in the developing container 121 is mixed by the conveying member 126 and is supplied to the developing roller 142. The developer supplied is born on and conveyed by the developing roller 142, magnetized by the magnetic force of the permanent magnet 144 in the regulating sleeve 143 and regulated in a developer regulating region (G). Details of the developer regulating region (G) are illustrated in FIG. 26B. FIG. 26B is an enlarged view of the developer regulating region (G) in FIG. 26A.

A magnetic carrier in the developer regulated by the magnetic field in the developer regulating region (G) is restricted by the magnetic force of the permanent magnet 144 in the regulating sleeve 143. Since the regulating sleeve 143 rotates in the direction indicated by an arrow illustrated in the drawings, the magnetic carrier is subject to a conveying force in the direction (A) returning it to the developing container 121. Thus, the magnetic carrier is sequentially returned to the developing container 121 by the conveying force from the regulating sleeve 143 while being restricted in the developer regulating region (G). Due to this, the magnetic carrier circulates in the developing container as indicated by an arrow in the drawings without leaking to a developing portion that faces the image bearing member 101.

On the other hand, the non-magnetic toner in the developer regulating region (G) is not restricted by the magnetic field in the developer regulating region (G). Moreover, a mirroring force from the developing roller 142, being caused by the charge formed by the frictional charging between the magnetic carrier and the surface of the developing roller 142, acts on the non-magnetic toner. Thus, the non-magnetic toner is subject to the conveying force in the rotation direction (B) of the developing roller 142 with the rotation of the developing roller 142 and passes through the developer regulating region (G) so that the non-magnetic toner is coated on the developing roller 142.

In this manner, only the non-magnetic toner that is sufficiently charged is coated on the developing roller 142 while preventing the leakage of the magnetic carrier.

Since the developing methods disclosed in Japanese Patent Laid-Open No. 60-042776 and Japanese Patent Laid-Open No. 10-198161 take a configuration in which the toner bearing member is coated by the toner which makes physical contact with the toner bearing member, the amount of coat will not vary greatly with a variation in the toner charge amount (Q/M) like the hybrid developing method. Specifically, in the hybrid developing method, the amount of coat increases when the toner charge amount decreases. In contrast, the developing methods disclosed in Japanese Patent Laid-Open No. 60-042776 and Japanese Patent Laid-Open No. 10-198161 can suppress an increase in the amount of coat. That is, since these developing methods can suppress the variation in the amount of coat with the variation in the toner charging amount, it is possible to suppress the variation in the image density.

Although these methods can suppress the variation in the toner layer thickness in a vertical direction, it is found that the arrangement position of the toner coat in a plane is not uniform but is uneven. In this case, a region in which toner is not coated is present approximately in parallel to the rotation direction of the developing roller, and an unevenness occurs in the toner layer on the surface of the developing roller.

It is therefore difficult to form a toner layer uniformly on the developing roller which may directly lead to image defects. This problem is particularly evident when the toner layer is thin.

When the toner layer includes a plurality of layers, even if the toner layer on the toner bearing member is slightly non-uniform, a toner image on the image bearing member is made uniform by an AC bias applied and is rarely identified as an image defect.

On the other hand, when the toner layer includes substantially a single layer, it is not possible to prevent image defects due to the above effect. This is because, although the toner image can be made uniform, since an absolute toner amount is not sufficient, a portion where the sheet is not completely coated with toner may occur, and an allowable density unevenness is not attained. As a result, the portion is identified as an image defect.

The problem results from the following mechanism. This mechanism will be described with reference to FIGS. 27A and 27B. FIGS. 27A and 27B are diagrams for describing the mechanism of the problem of the related art. FIG. 27A schematically illustrates the toner layer coated on the developing roller and the magnetic brush returned to the developing container by the regulating sleeve in the developer regulating region (G).

Although a large amount of magnetic brushes are conveyed by the developing roller, and a large amount of magnetic brushes present in the developer regulating region (G) are returned to the developing container by the regulating sleeve, some magnetic brushes are not illustrated.

As in FIG. 27A, the toner layer coated on the developing roller is disturbed by the magnetic brush conveyed by the regulating sleeve when the toner layer passes through the developer regulating region (G). Moreover, in order for the toner to uniformly make contact with the surface of the developing roller, it is necessary to apply a sufficient relative difference to a moving speed of the surface of the developing roller and the conveying speed of the developer on the developing roller. This is to secure a sufficiently high contact frequency for allowing the surface of the developing roller to make contact with the toner coated on the magnetic carrier.

Due to this, the coated toner layer is also disturbed by a subsequent magnetic brush that is conveyed by the developing roller and passes the toner layer as well as the magnetic brush that is conveyed by the regulating sleeve. FIG. 27B is a diagram schematically illustrating a state where the toner coated on the developing roller is disturbed by the magnetic brush.

As illustrated in FIG. 27B, when the magnetic brush collides with the toner coated on the developing roller, the toner moves or rotates on the developing roller, and the adhering force (mirroring force) of the toner in relation to the developing roller decreases.

In this case, since a magnetic carrier at the tip of the magnetic brush has toner coated on the developing roller on the downstream side, the magnetic carrier is charged with a reverse polarity by a charge amount of toner consumed. Due to this, the toner coated on the developing roller is scraped by the magnetic carrier when the toner passes through the developer regulating region (G).

Due to the reasons, a scrape mark of the magnetic carrier appears in parallel to the moving direction of the magnetic brush (that is, mainly the rotation direction of the developing roller and the regulating sleeve), and it is not possible to coat a uniform toner layer.

SUMMARY OF THE INVENTION

In order to solve the problems described above, it is desirable to coat a uniform toner layer stably on a toner bearing member in a configuration where the toner layer is coated on the toner bearing member by allowing a two-component developer to make contact with the surface.

In order to accomplish the above-mentioned aspect, as a representative configuration, the present invention provides a developing device including: a developing container that stores a developer including a non-magnetic toner and a magnetic carrier; and a toner bearing member that bears the toner and conveys the toner to a developing portion formed between the toner bearing member and an image bearing member on which an electrostatic latent image is formed, wherein a surface of the toner bearing member includes a plurality of recess structures in which a smallest opening width R is equal to or larger than $r_{t10}$ and equal to or smaller than $r_{c10}$ (where $r_{t10}$ is a particle diameter in which an accumulated number distribution in a toner granularity distribution is 10%, and $r_{c10}$ is a particle diameter in which an accumulated number distribution in a carrier granularity distribution is 10%), and a depth D is equal to or larger than $r_{t10}/2$ and a percentage of the recess structures per unit area in at least a toner bearing region of the toner bearing member is equal to or larger than 55%.

Due to the above configuration, it is possible to coat a uniform toner layer stably on a toner bearing member in a configuration where the toner layer is coated on the toner bearing member by allowing a two-component developer to make contact with the surface.

Further features of the present invention will become apparent from the following description of exemplary embodiments with reference to the attached drawings.

BRIEF DESCRIPTION OF THE DRAWINGS

FIG. 10A is an explanatory diagram for comparison of coats.

FIG. 10B is an explanatory diagram for comparison of coats.

FIG. 10C is an explanatory diagram for comparison of coats.

FIG. 12A is an explanatory diagram for comparison of coats.

FIG. 12B is an explanatory diagram for comparison of coats.

FIG. 12C is an explanatory diagram for comparison of coats.

FIG. 13A is a diagram illustrating an expression used in a method of measuring a granularity distribution of recess structures on a toner conveying member.

FIG. 13B is a diagram illustrating an expression used in a method of measuring a granularity distribution of recess structures on a toner conveying member.

FIG. 13C is a diagram illustrating an expression used in a method of measuring a granularity distribution of recess structures on a toner conveying member.

FIG. 13D is a diagram illustrating an expression used in a method of measuring a granularity distribution of recess structures on a toner conveying member.

FIG. 13E is a diagram illustrating an expression used in a method of measuring a granularity distribution of recess structures on a toner conveying member.

FIG. 13F is a diagram illustrating an expression used in a method of measuring a granularity distribution of recess structures on a toner conveying member.

FIG. 13G is a diagram illustrating an expression used in a method of measuring a granularity distribution of recess structures on a toner conveying member.

FIG. 13H is a diagram illustrating an expression used in a method of measuring a granularity distribution of recess structures on a toner conveying member.

FIG. 13I is a diagram illustrating an expression used in a method of measuring a granularity distribution of recess structures on a toner conveying member.

FIG. 16A is a diagram illustrating $\int G(x)dx$ and a density evaluation result of each toner conveying member.

FIG. 16B is a diagram illustrating a variation $\Delta\int G(x)dx$ and uniformity evaluation results.

FIG. 19A is a diagram illustrating an expression used in a method of calculating $\int G(x)$.

FIG. 19B is a diagram illustrating an expression used in a method of calculating $\Delta(\int G(x)dx)$.

FIG. 22A is a diagram illustrating an expression used in the description of the second embodiment.

FIG. 22B is a diagram illustrating an expression used in the description of the second embodiment.

FIG. 22C is a diagram illustrating an expression used in the description of the second embodiment.

DESCRIPTION OF THE EMBODIMENTS

Figure 1:
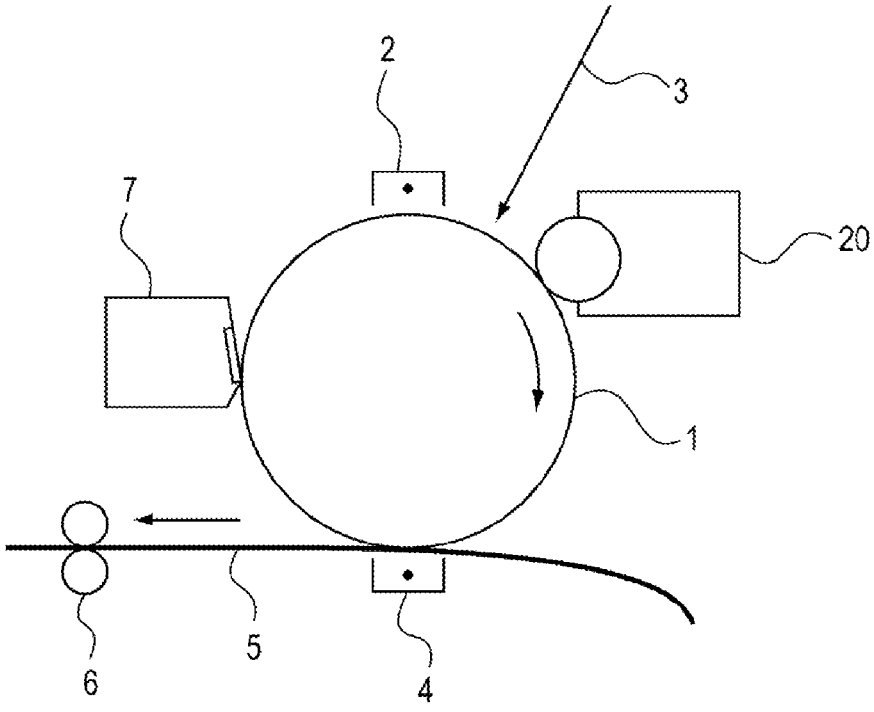
FIG. 1 is a diagram illustrating an image forming apparatus which uses an electrophotographic system.

Hereinafter, embodiments of a developing device according to the present invention will be described in detail with reference to the drawings. The present invention will be described by way of an example in which the present invention is implemented in an image forming apparatus which uses an electrophotographic system as illustrated in FIG. 1. Dimensions, materials, shapes, and other relative arrangement and the like of constituent components described in these embodiments are not intended to limit the scope of the present invention thereto. FIG. 1 is a diagram illustrating an image forming apparatus which uses an electrophotographic system.

The image forming apparatus which uses an electrophotographic system as illustrated in FIG. 1 includes a rotatable drum-shaped photosensitive member 1 (electrophotographic photosensitive member) formed by applying a photoconductive layer on a conductive substrate as an image bearing member that bears an electrostatic latent image. The photosensitive member 1 is uniformly charged by a charging unit 2, and subsequently an information signal is exposed by a light emitting element 3 such as a laser, for example, to form an electrostatic latent image. After that, the electrostatic latent image is visualized by a developing device 20. Subsequently, a transfer charger 4 transfers the electrostatic latent image to a transfer material 5, and a fixing device 6 fixes a toner image to the transfer material 5. Moreover, a residual transfer toner on the photosensitive member 1 is cleaned by a cleaning device 7.

First Embodiment

Figure 2:
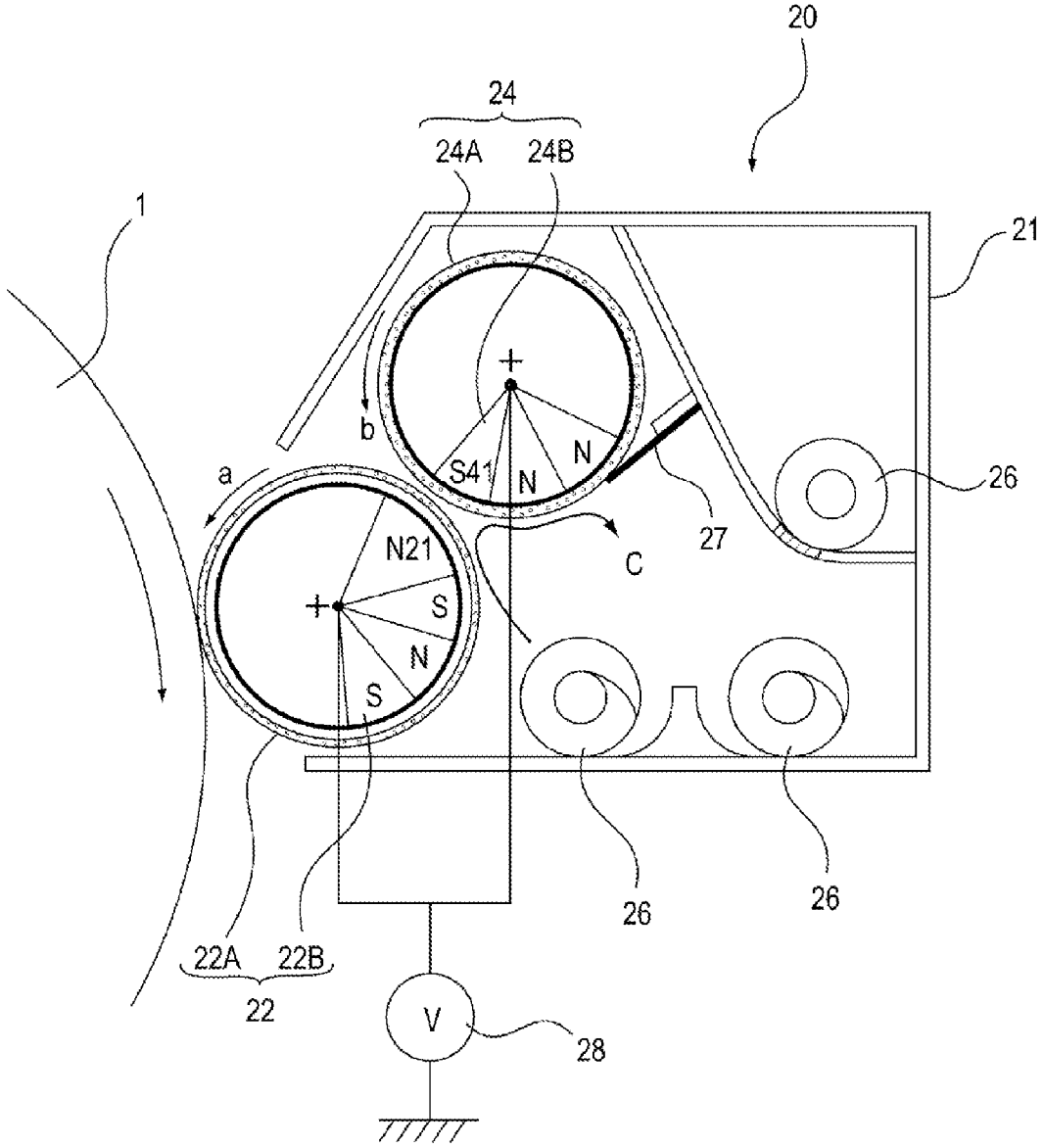
FIG. 2 is a diagram illustrating a schematic configuration of a developing device according to a first embodiment.

FIG. 2 is a diagram illustrating a schematic configuration of a developing device according to a first embodiment. A developing device 20 according to the present embodiment includes a toner bearing member 22 that is disposed in an opening of a developing container 21 so as to face a photosensitive member 1. The toner bearing member 22 includes a toner conveying member 22A that conveys toner to a developing portion and a plurality of permanent magnets 22B that are fixedly disposed inside the toner conveying member 22A.

The toner conveying member 22A is formed of an elastic and flexible member and is disposed so as to make contact with the photosensitive member 1, and developing is performed in the contacting developing portion. Moreover, the toner conveying member 22A is rotatably provided so as to move in the same direction, at the facing portion, as the rotation direction of the photosensitive member 1, and both speeds are set to be approximately the same.

Figure 3A:
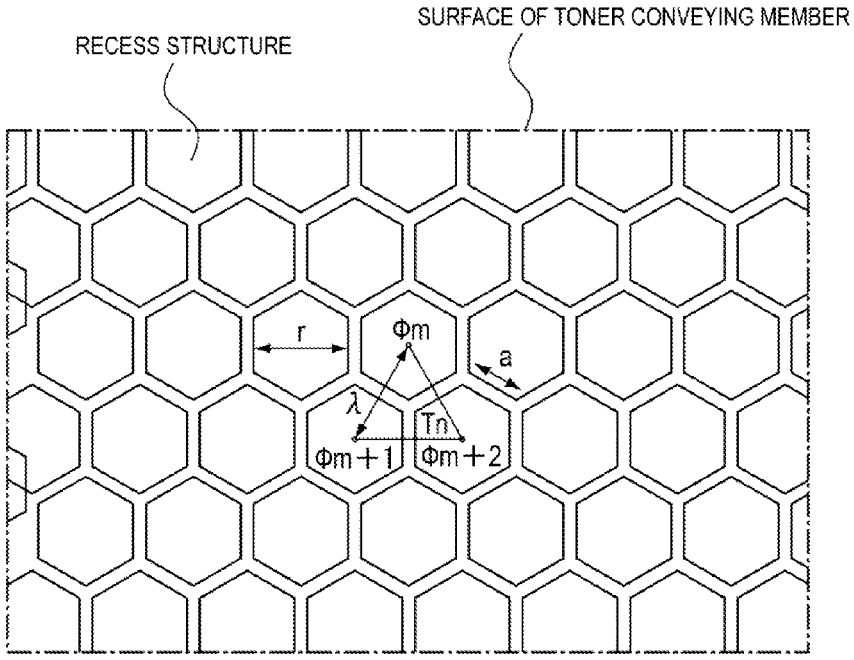
FIG. 3A is a schematic diagram of the surface of a toner conveying member according to the first embodiment.
Figure 3B:
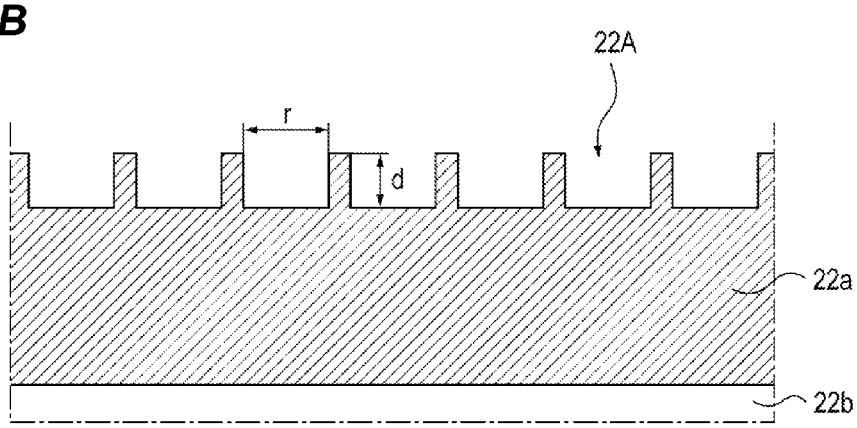
FIG. 3B is a schematic diagram of the surface of the toner conveying member according to the first embodiment.

FIGS. 3A and 3B are schematic diagrams of the surface of the toner conveying member according to the first embodiment.

As illustrated in FIG. 3A, the surface in at least a toner conveying region of the toner conveying member has honeycomb-shaped recess structures. One side (that is, a length $\lambda$) of a triangle, Tn, formed by connecting the centers of three adjacent openings $\phi m$, $\phi m+1$, and $\phi m+2$ is 7.5 μm, an opening width, r, of the opening is 6.5 μm, and the length, a, of one side of the opening is 4.3 μm. As illustrated in FIG. 3B schematically illustrating a cross-section of the surface layer of the toner conveying member 22A, a plurality of recess structures are formed on an elastic layer. A depth, d, of the recess structure is 3.5 μm. A method of measuring the recess structure will be described later. The toner conveying region in the present invention is a region that corresponds to a largest image forming region of at least the photosensitive member in the longitudinal direction of the toner conveying member.

The toner conveying member 22A is formed of a member having a structure in which an elastic layer 22*a* is coated on a cylindrical member having a base 22*b* formed of a metal material.

The base 22*b* can be formed of SUS, iron, aluminum, or the like as long as the material is conductive and rigid.

The elastic layer 22*a* includes a base formed of a rubber material having an appropriate elasticity such as silicone gum, acrylic rubber, nitrile rubber, polyurethane rubber, ethylene propylene rubber, isopropylene rubber, or styrene-butadiene rubber. Conductive fine particles such as carbon black, titanium oxides, or metallic fine particles are added to the base to provide conductive properties. Moreover, a plurality of recess structures are formed on the surface of the elastic layer 22*a* by thermal nanoimprinting.

In the present embodiment, although the recess structures are formed directly on the elastic layer 22*a*, a conductive particle-added photo-curable or thermoplastic resin may be applied on the elastic layer 22*a* and the recess structure may be formed on the resin by photo-nanoimprinting or thermal nanoimprinting. The recess structure may be formed according to other methods such as laser etching in addition to nanoimprinting. A method of forming the recess structure will be described later.

As illustrated in FIG. 2, the developing container 21 stores a developer that includes a non-magnetic toner and a magnetic carrier, and a mixing and supplying member 26 for supplying the developer in the developing container 21 towards the toner conveying member 22A is arranged inside the developing container 21.

Further, a developer collecting member 24 is disposed within close proximity to the toner conveying member 22A. The developer collecting member 24 functions as a separating unit (separating portion) for collecting or separating the magnetic carrier from the developer conveyed by being born on the toner conveying member 22A. As illustrated in FIG. 2, the developer collecting member 24 is arranged on the downstream side of the developing portion in relation to the moving direction of the toner conveying member 22A. Moreover, the developer collecting member 24 is arranged on the downstream side of a supply portion that supplies the developer with the aid of the mixing and supplying member 26. The permanent magnets 22B disposed inside the toner conveying member 22A, and the permanent magnets 24B disposed inside the developer conveying member 24A form a magnetic field in cooperation.

The developer collecting member 24 includes a rotatable developer conveying member 24A and a plurality of permanent magnets 24B that are fixedly disposed inside the developer conveying member 24A.

The developer conveying member 24A is formed of a cylindrical non-magnetic metal material and is provided so as to be rotatable in the same direction "b" as the rotation direction "a" of the toner conveying member 22A. Both are disposed in a non-contacting manner at a distance of 2 mm or smaller.

The permanent magnets 22B in the toner conveying member 22A each have two N and S poles arranged alternately. On the other hand, the permanent magnets 24B in the developer conveying member 24A have two N poles and one S pole.

As illustrated in FIG. 2, a magnetic pole N21 of the permanent magnet 22B in the toner conveying member 22A, and a magnetic pole S41 of the permanent magnet 24B in the developer conveying member 24A are disposed to face each other so that the magnetic poles of both facing portions are opposite. Further, N poles are arranged on the downstream side in the rotation direction of the magnetic pole S41 of the developer conveying member 24A.

The magnetic poles N21 and S41 are set so that the width of the magnetic pole S41 is narrower than the width of the magnetic pole N21. Due to this, the flux density of the magnetic field formed between the magnetic poles, S41 and N21, increases as it advances from the toner conveying member 22A toward the developer conveying member 24A.

In the developing device illustrated in FIG. 2, the flux density increases as it advances from the toner conveying member 22A toward the developer conveying member 24A. Thus, magnetic force directed from the toner conveying member 22A and the developer conveying member 24A acts on the magnetic carrier present between the toner conveying member 22A and the developer conveying member 24A. As a result, a magnetic carrier brush is formed along the magnetic field created by magnetic poles N21 and S41.

Moreover, the developer conveying member 24A rotates in the same direction "b" as the rotation direction "a" of the toner conveying member 22A. Due to this, by a frictional force between the force of magnetic field and the surface of the developer conveying member 24A, a conveying force directed from the developer conveying member 24A toward the inside of the developing container 21 is applied to the magnetic carrier born on the surface of the developer conveying member 24A by the magnetic force.

The magnetic carrier on the surface of the developer conveying member 24A is removed by a scraper 27, having one end held on the developing container 21 near a position where the N poles of the permanent magnet 24B are arranged, the removed magnetic carrier is returned into the developing container 21. The magnetic carrier returned into the developing container 21 is mixed with the non-magnetic toner by the mixing and supplying member 26. The magnetic carrier is, again, conveyed to the surface of the toner conveying member 22A and conveyed to the position where the magnetic poles N21 and S41 face each other. That is, the magnetic carrier circulates along a path indicated by an arrow "C" in the drawing.

On the other hand, the non-magnetic toner is coated on the magnetic carrier and makes contact with the toner conveying member 22A in the course of being conveyed on the toner conveying member 22A. In such a case, toner makes multipoint contact with the recess structure of the toner conveying member 22A and coats the recess structure. When the toner makes multipoint contact in this manner, the toner can be coated with small electrostatic adhering force as compared to making multipoint contact with a flat surface. That is, the amount of toner coated in the recess structure is stable in relation to a variation in toner charge amount as compared to a flat surface. The nature in which the contacting toner adheres to the toner conveying member 22A is affected by the triboelectric series of the toner, the magnetic carrier, and the surface of the toner conveying member.

Figure 4:
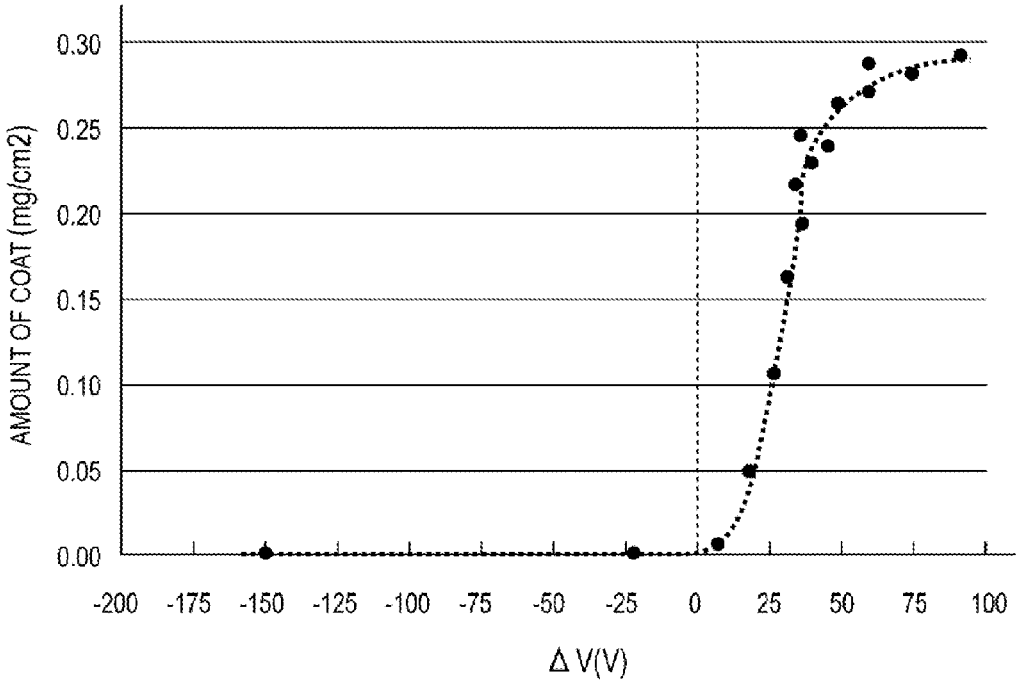
FIG. 4 is a graph illustrating the relationship between a surface potential of a magnetic carrier and an amount of coat of toner adhering on a base.

FIG. 4 is a graph illustrating the relationship between the surface potential of the magnetic carrier and the amount of toner coat adhering to the base. Specifically, the horizontal axis represents the surface potential ($\Delta V$) immediately after a magnetic carrier is brought into contact with a base coated in the same material as the surface of the toner conveying member to cause frictional charging. Moreover, the vertical axis represents the amount of toner coat adhering to the base when a two-component developer, including a magnetic carrier, is brought into contact with the base to cause frictional charging.

In this case, toner is negatively charged by the friction with a magnetic carrier having a negative charging property. As in the drawing, toner is likely to adhere to the base that exhibits a positive charging property ($\Delta V>0$) as compared to the magnetic carrier. On the other hand, toner is unlikely to adhere to the base that exhibits a negative charging property ($\Delta V<0$).

Figures 5A, 5B:
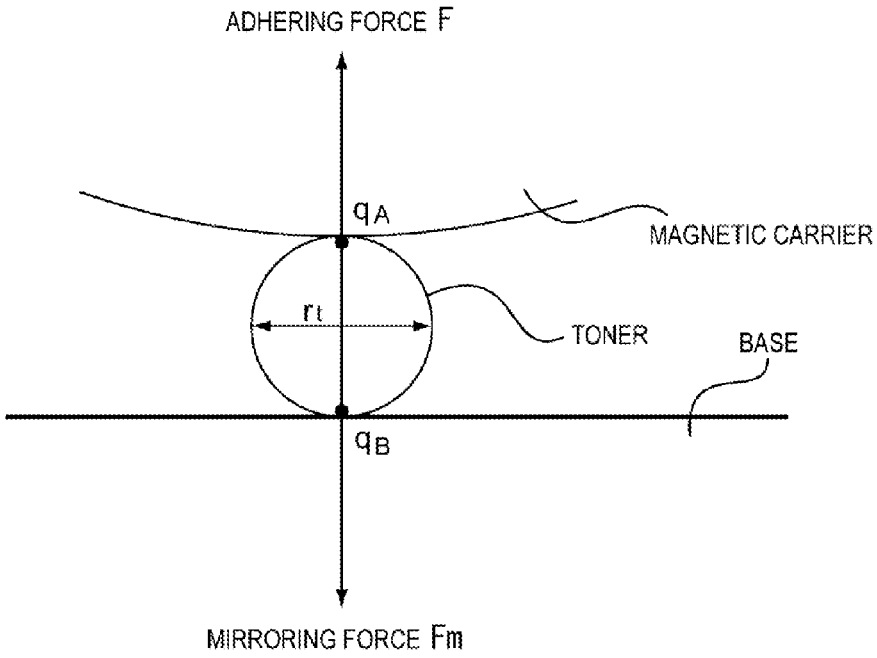
FIG. 5A is a schematic diagram illustrating the main force components acting on toner which makes contact with the base.
FIG. 5B is a diagram illustrating expressions representing an adhering force and a mirroring force of toner.

This is based on the following reasons. FIG. 5A is a schematic diagram illustrating main force components acting on toner that makes contact with the base, and FIG. 5B is a diagram illustrating expressions representing an adhering force and a mirroring force acting on the toner.

As illustrated in FIG. 5A, charges are generated on the toner by the frictional charging between the magnetic carrier and the base, and an electrostatic adhering force F and a mirroring force Fm act in the direction indicated by arrows in the drawing. For the toner to be desorbed from the magnetic carrier and to adhere to the base, the mirroring force Fm needs to be larger than the adhering force F.

In order to estimate the relationship of both force components, the charges generated by the frictional charging between the magnetic carrier and the base are assumed to be point charges, $q_A$ and $q_B$ respectively, the adhering force F and the mirroring force Fm are expressed as illustrated in FIG. 5B.

In FIG. 5B, $\alpha$ and $\beta$ are constants, and "a" and "b" are distances between point charges, which are assumed to be sufficiently smaller than the toner diameter "r". For the mirroring force Fm to be larger than the adhering force F, the charge $q_B$ generated by the frictional charging between the toner and the base needs to be larger than the charge $q_A$ generated by the frictional charging between the toner and the magnetic carrier. This means the base needs to have a higher charging property than the magnetic carrier.

The triboelectric series of the surface of the toner conveying member 22A, the toner and the magnetic carrier, are arranged so that the charging property of the magnetic carrier is between those of the toner and the surface of the toner conveying member 22A. In this case, the charging property of the toner with respect to the toner conveying member 22A is superior to that of the magnetic carrier, and when the toner makes contact with the toner conveying member 22A, the toner is likely to be desorbed from the magnetic carrier and adhere to the toner conveying member 22A.

Figure 6:
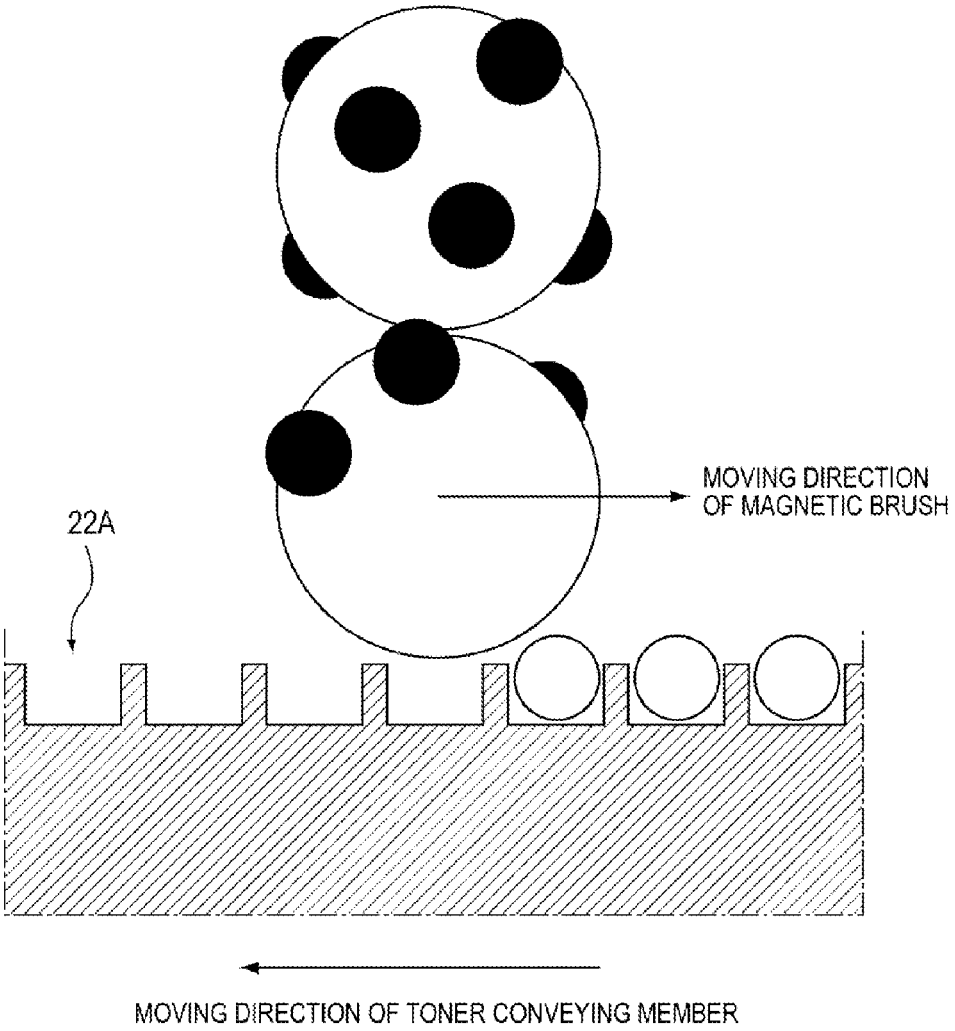
FIG. 6 is a schematic diagram illustrating a state where toner that is desorbed from a magnetic carrier and adheres to a toner conveying member is conveyed.

FIG. 6 is a schematic diagram illustrating a state where the toner that is desorbed from the magnetic carrier and adheres to the toner conveying member is conveyed. The toner adhering to the recess structure on the toner conveying member 22A is fixed in the recess structure to which the magnetic carrier cannot enter even when the magnetic brush passes. Due to this, the toner is suppressed from moving and rotating, and scraping by the magnetic carrier can also be suppressed.

The magnetic carrier is returned into the developing container 21 from the position where the toner conveying member 22A and the developer conveying member 24A face each other. Due to this, the toner adhering to the recess structure is uniformly coated on the toner conveying member 22A, and can be conveyed to the developing portion where the toner conveying member 22A and the photosensitive member 1 make contact with each other.

An electric field application portion 28 applies a developing bias voltage between the toner conveying member 22A and the photosensitive member 1. Moreover, the toner bearing member 22 and the core metal of the developer collecting member 24 are electrically connected so as to be at the same potential. The toner conveyed to the developing portion is developed by the developing bias voltage.

Figure 7:
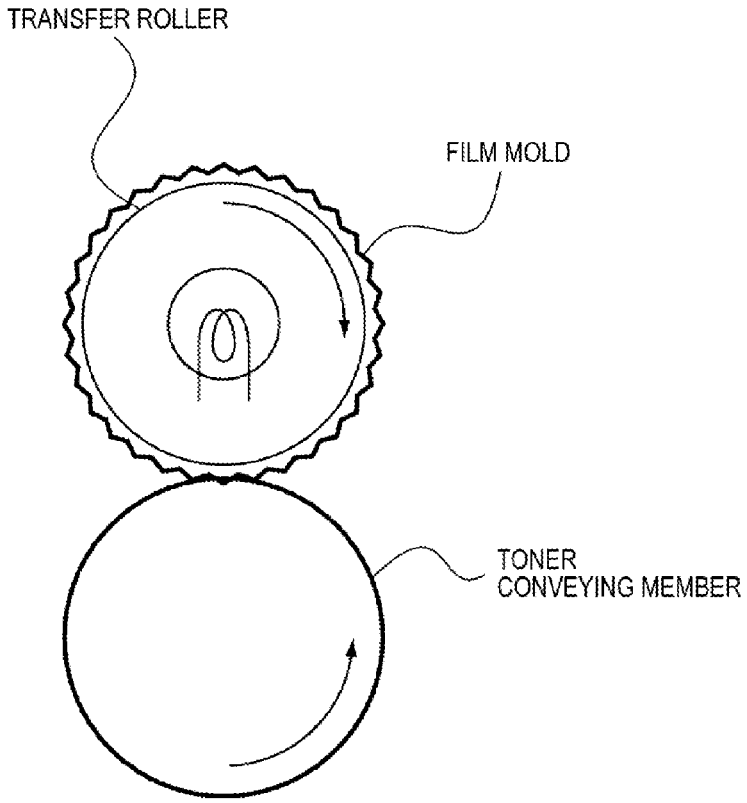
FIG. 7 is a schematic diagram illustrating a method of forming a recess structure on a toner conveying member.

(Recess Structure Forming Method) The recess structure on the toner conveying member 22A used in the present embodiment is formed according to a thermal nanoimprinting method. FIG. 7 is a schematic diagram illustrating a method of forming a recess structure on the toner conveying member.

As illustrated in FIG. 7, a film mold having a convex structure, which is a reverse structure of a desired recess structure, is fixed on a transfer roller having a halogen heater included therein and is brought into pressing contact with the toner conveying member. While slowly rotating the transfer roller and the toner conveying member, the halogen heater heats the toner conveying member within the range of a melting point from a glass-transition temperature to thereby form the recess structure. The recess structure can be formed according to other methods. For example, according to a photo-nanoimprinting method, a photo-curable resin is applied on the toner conveying member, a mold is brought into contact with the toner conveying member from the above, and a UV light from a upper position is irradiated on the mold, whereby the recess structure can be formed on the toner conveying member. Moreover, the recess structure can be formed according to a laser edging method of a scanning laser while rotating the toner conveying member.

(Recess Structure Measuring Method) The recess structure on the surface of the toner conveying member is measured according to an operation manual of a measuring device using an atomic force microscope (AFM). In this case, the surface of the toner bearing member is cut using a cutter, a laser, or the like to create a flat and smooth sheet-shaped sample.

Figure 8:
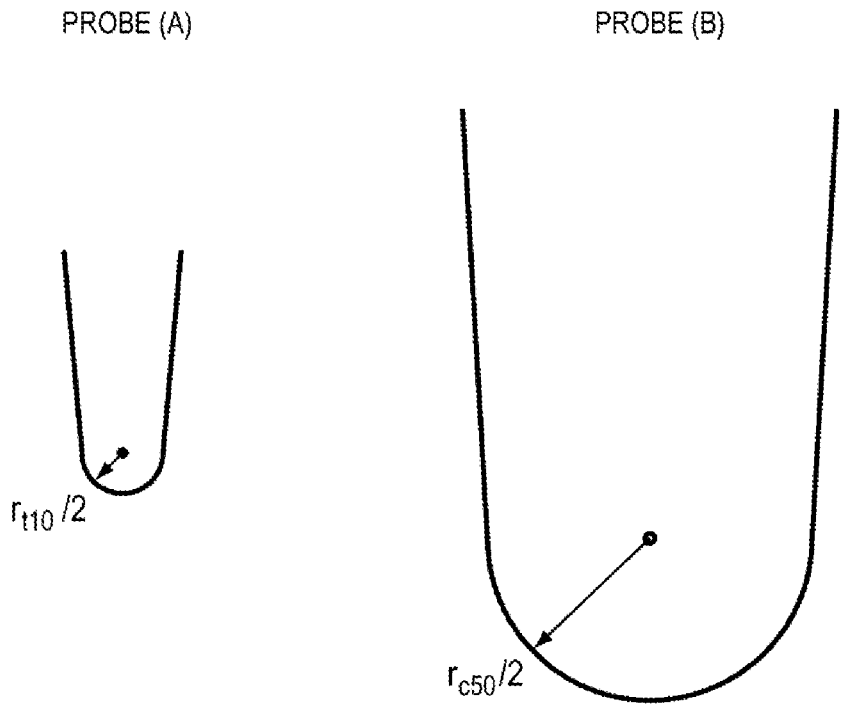
FIG. 8 is a schematic diagram illustrating tip (probe) shapes of two cantilevers used in measurement of the recess structure on the toner conveying member.

FIG. 8 is a schematic diagram illustrating tip (probe) shapes of two cantilevers used for measurement of the recess structure on the toner conveying member. A probe (A) is a hemispherical probe of which the tip has a diameter corresponding to a toner particle diameter $r_{t10}$. A probe (B) is a hemispherical probe of which the tip has a diameter corresponding to a carrier particle diameter $r_{c50}$.

A specific measuring method will be described. First, the shape $(x, y, z_B)$ of the surface of the toner conveying member is measured using the probe (B). This shape represents the shape of the surface of the toner conveying member that the magnetic carrier of the carrier particle diameter $r_{c50}$ can make contact with and serves as a reference surface. Subsequently, the shape $(x, y, z_A)$ at the same position is measured using probe (A).

This shape represents the shape of the surface of the toner conveying member that the toner of the toner particle diameter $r_{t10}$ can make contact with. A difference $(|z_B-z_A|)$ (that is, a depth D from the reference surface) in the height direction of the measured shapes is measured, and coordinates (x, y) at which $D=|z_B-z_A|\geq r_{t10}/2$ is satisfied are extracted. A circle having a diameter of $r_{t10}$ and the center at the coordinate is applied to each of the extracted coordinates by taking the shape of the probes into consideration, and image processing is performed.

Figure 9A:
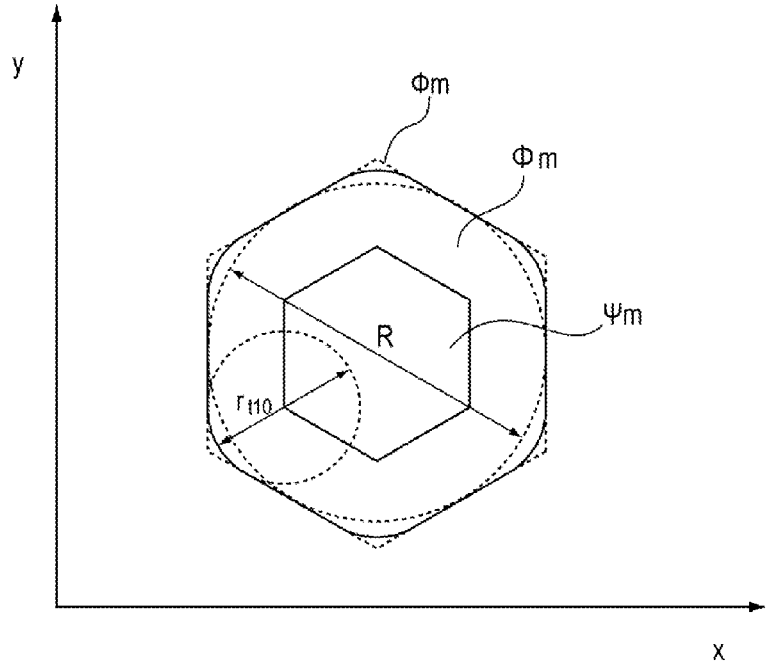
FIG. 9A is a diagram illustrating the measurement of an opening of a recess structure and the results of image processing.
Figure 9B:
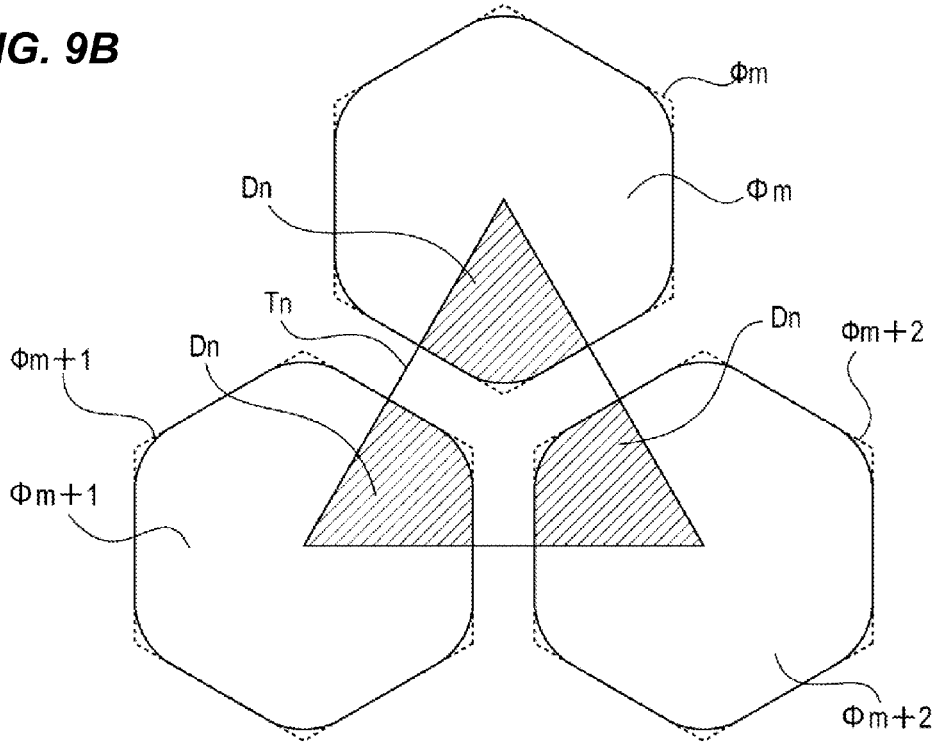
FIG. 9B is a diagram illustrating the measurement of an opening of a recess structure and the results of image processing.

FIGS. 9A and 9B are diagrams illustrating the measurement of a recess opening and the results of image processing. First, FIG. 9A illustrates the results of the measurement of an opening ϕm and the results of image processing. The opening ϕm is obtained by superimposing circles having a diameter of $r_{t10}$ and the center at the respective coordinates of the extracted coordinate group ψm. Moreover, the largest diameter (that is, the smallest opening width R of ϕm) of a circle that is received in ϕm is obtained. The R obtained by the measurement is 6.5 μm.

FIG. 9B illustrates the results of the measurement of the recess structure and the results of image processing on three adjacent openings ϕm, ϕm+1, and ϕm+2. A triangle Tn is created by connecting the centers of the openings ϕm, ϕm+1, and ϕm+2 obtained by image processing and a region in which the openings ϕm, ϕm+1, and ϕm+2 and the triangle Tn overlap is referred to as Dn.

Using image processing software, the area $S_{Tn}$ of the triangle Tn, the area $S_{Dn}$ of the region Dn, and an area ratio x $(=S_{Dn}/S_{Tn})$ are obtained. The $S_{Tn}$ and $S_{Dn}/S_{Tn}$ obtained by the measurement are $2.4\times10^{-11}$ $m^2$ and $9.9\times10^{-1}$ $m^2$.

The recess structure in the present invention is a recess structure having the opening ϕm obtained by the measurement and image processing. That is, a structure having a short cycle in which the probe (A) cannot enter and a structure having a long cycle in which the probe (B) can enter do not affect the object of the present invention and the structures may be included in the surface of the toner conveying member. Moreover, an incomplete recess structure in which actually a very small region is partially broken is also regarded as the recess structure of the present invention as long as the recess structure is measured and determined to be a recess structure.

Next, comparison of coats will be described with reference to the drawings. FIGS. 10A to 10C, 11A to 11C, and 12A to 12C are explanatory diagrams for comparison of coats.

(Charging Series-based Coat Comparison) Three types of magnetic carriers (A, B, and C) of which the charging properties are changed by adjusting a coating material of the magnetic carrier are prepared. The surface of the toner conveying member is positively charged by the carrier A, is rarely charged by the carrier B, and is negatively charged in relation to the carrier C. The method of measuring triboelectric series will be described later. Moreover, the respective carriers are subjected to frictional charging and whereby toner components charged in positive and negative polarities are prepared.

FIG. 10A illustrates the evaluation results of the coats on the toner conveying member when the carrier is changed. Specifically, the results of the evaluation of the coats on the toner conveying member using a developer and a toner conveying member are illustrated.

The coats are evaluated using a microscope and by observing 100 recess structures at an arbitrary position on the toner conveying member after coating, the time t required for 80% or more of the openings of the recess structures to be coated by the toner is measured. The coats are evaluated based on the following evaluation criteria.

X: 1 s<t, O: t≤1 s (1 s time required for the toner bearing member to make one rotation)

(Charging Series Measuring Method) Only a magnetic carrier is filled in the developing container 21, and a normal developing operation is performed for approximately one minute. In this case, an electric field application unit is separated so that the toner bearing member 22 and the developer collecting member 24 are put into an electrically floating state. A probe of a surface potentiometer is placed so as to face the downstream side of the portion where the magnetic poles N21 and S41 face (that is, the toner conveying member on which the magnetic carrier is not born) and the surface potential is measured.

The potential difference (potential after the operation−potential before the operation) before and after the developing operation is measured. If the potential difference is positive, the toner conveying member can be determined to be on the positive side on the triboelectric series as compared to the magnetic carrier. If the potential difference is negative, the toner conveying member can be determined to be on the negative side.

On the other hand, since it can be determined whether toner is on the positive side on the triboelectric series or on the negative side as compared to the magnetic carrier by the frictional charging of the magnetic carrier and the toner, it is possible to determine a relative triboelectric series of a 3rd party.

In FIG. 10A, the condition where the opening can be coated in a short time (1 s or smaller) is a case where the triboelectric series of the surface of the toner bearing member 22, the toner, and the magnetic carrier are arranged so that the magnetic carrier is between the toner and the surface of the toner bearing member 22. In the condition, when the toner electrostatically adhering to the magnetic carrier makes contact with the surface of the toner bearing member, the toner is likely to be desorbed from the magnetic carrier and adhere to the toner bearing member 22. Due to this, it is possible to coat a uniform toner layer without excessively increasing the contact frequency between the developer and the surface of the toner bearing member 22.

(Coat Comparison) A carrier, A, a toner, TA, that is negatively charged in relation to the carrier, A, and a toner conveying member that is positively charged in relation to the carrier, A, are prepared. A plurality of toner conveying members in which the opening width, r, and the depth, d, of a recess structure which for example may be a honey comb-shape structure on the surface are varied is prepared.

FIG. 10B is a graph illustrating the measurement result of a granularity distribution of the used toner, TA. FIG. 10C is a graph illustrating the measurement result of a granularity distribution of the used carrier, A. The method of measuring the granularity distribution will be described later. A toner particle diameter, $r_{t10}$, at which the accumulated number distribution in the toner granularity distribution is 10% is 4.0 μm. Similarly, a carrier particle diameter, $r_{c10}$, at which the accumulated number distribution in the carrier granularity distribution is 10% is 30 μm. The toner density ratio (TD ratio) in the developer is 12%.

Figures 11A, 11B, 11C:
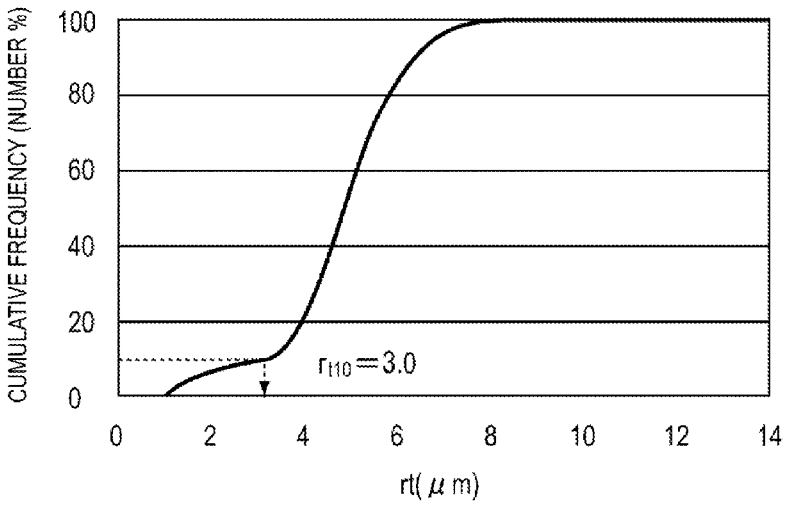
FIG. 11A is an explanatory diagram for comparison of coats.
FIG. 11B is an explanatory diagram for comparison of coats.
FIG. 11C is an explanatory diagram for comparison of coats.

FIG. 11A is a table illustrating the evaluation result of the coats on the toner conveying member.

A carrier, A, a toner, TB, that is negatively charged in relation to the carrier, A, and a toner conveying member that is positively charged in relation to the carrier, A, are prepared and the same examination is conducted. FIG. 11B is a graph illustrating the measurement result of the granularity distribution of the toner, TB. The toner particle diameter, $r_{t10}$, is 3.0 μm and the carrier particle diameter $r_{c10}$ is 30 μm. FIG. 11C is a table illustrating the evaluation result of the coats on the toner conveying member.

Similarly, the coats on the toner conveying member are evaluated using a carrier, C, and a toner, TC, that positively charges the carrier, C.

FIG. 12A is a graph illustrating the measurement results of the granularity distribution of the used toner, TC. FIG. 12B is a graph illustrating the measurement results of the granularity distribution of the used carrier, C. The toner particle diameter, $r_{t10}$, is 3.0 μm and the carrier particle diameter, $r_{c10}$, is 15 μm. The toner density ratio (TD ratio) in the developer is adjusted to 18% so that approximately the same amount of toner as the carrier, A, is coated by taking the carrier surface ratio into consideration. FIG. 12C is a table illustrating the evaluation result of the coats on the toner conveying member.

In order for both developers to satisfy allowable level of the coat evaluation, it is necessary that the opening width, R, is equal to or larger than the toner particle diameter, $r_{t10}$, and equal to or lower than the carrier particle diameter, $r_{c10}$, and the depth, D, is equal to or larger than $r_{t10}/2$. If the opening width, R, is smaller than the toner particle diameter, $r_{t10}$, the toner that can be coated on the recess structure is excessively limited and the number of recess structures that cannot be coated increases.

On the other hand, if the opening width, R, is larger than the carrier particle diameter, $r_{c10}$, the number of magnetic carriers that can enter into the recess structure increases, and the scraping by the magnetic carrier becomes evident and the number of recess structures that cannot be coated increases. The reason why the effect of the magnetic carrier, of which the accumulated number distribution is smaller than 10%, is limited is because the magnetization amount is small due to a small particle size and the probability of being disposed at the tip of a magnetic brush is low.

Another reason is that it is difficult to apply a coupling force for rotating the toner when the magnetic carrier having a small magnetization amount collides with the toner coated on the recess structure. On the other hand, if the depth, D, is smaller than $r_{t10}/2$, when the magnetic carrier collides with the toner coated on the recess structure, it is considered that a coupling force acts on the toner coated on the recess structure and the toner is likely to rotate in the recess structure. Due to this, it is considered that the mirroring force with respect to the toner conveying member decreases and the scraping by the magnetic carrier becomes evident.

As described above, in order to coat the toner in the recess structure and suppress the scraping effect by the magnetic carrier, a plurality of recess structures of which the smallest opening width, R, is equal to or larger than $r_{t10}$ and equal to or smaller than $r_{c10}$ and the depth, D, is equal to or larger than $r_{t10}/2$ needs to be present on the surface of the toner conveying member.

Moreover, the triboelectric series of the surface of the toner conveying member, the toner, and the magnetic carrier are set so that the magnetic carrier is between the toner and the surface of the toner conveying member. Due to this, it is possible to coat a uniform toner layer without excessively increasing the contact frequency between the developer and the surface of the toner bearing member.

(Granularity Distribution Measuring Method) A toner granularity distribution is measured according to an operation manual of a measuring device using a coulter multi-sizer. Specifically, 0.1 g of a surfactant is added to 100 ml of an electrolyte (ISOTON) as a dispersant, and 5 mg of a measurement sample (toner) is added thereto. An electrolyte obtained by suspending the sample is subjected to distribution processing for approximately 2 minutes using an ultrasonic disperser to obtain a measurement sample. The number of samples is measured for each channel using an aperture of 100 μm, and a number distribution of samples is calculated.

The magnetic carrier granularity distribution is measured according to an operation manual of a measuring device using a laser diffraction granularity distribution meter. Specifically, 0.1 g of magnetic carrier is introduced into the device and the measurement is performed, and the number of samples is measured for each channel to calculate a number distribution of samples.

Next, a description is made based on expressions. FIGS. 13A to 13I are diagrams illustrating expressions used in a method of measuring a recess structure on the toner conveying member.

In order for a necessary amount of toner to be uniformly coated on the toner conveying member, the arrangement of recess structures on the toner conveying member is limited. The amount of coat (m/s) in the triangle, Tn, formed by three adjacent recess structures on the toner conveying member illustrated in FIG. 9B can be represented by the expression of FIG. 13A when it is considered that a total toner weight, m, is proportional to the region Dn.

That is, in order for a necessary amount of toner to be uniformly coated on the toner conveying member, it is necessary to optimize the distribution of ($S_{Dn}/S_{Tn}$) on the toner conveying member.

Figure 14A:
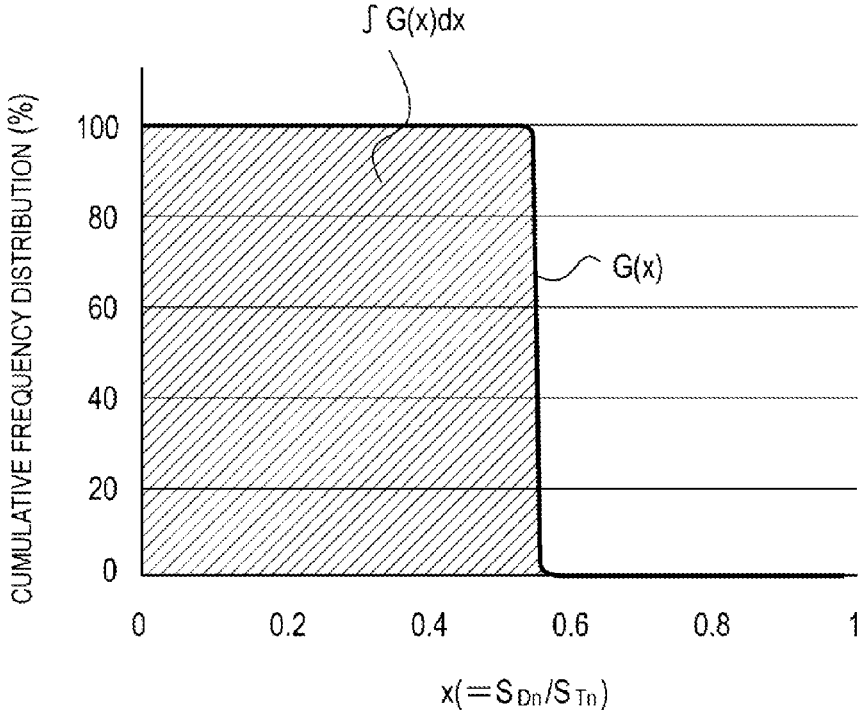
FIG. 14A is a graph illustrating a cumulative frequency distribution function on the surface of the toner conveying member and an integrated value thereof.
Figure 14B:
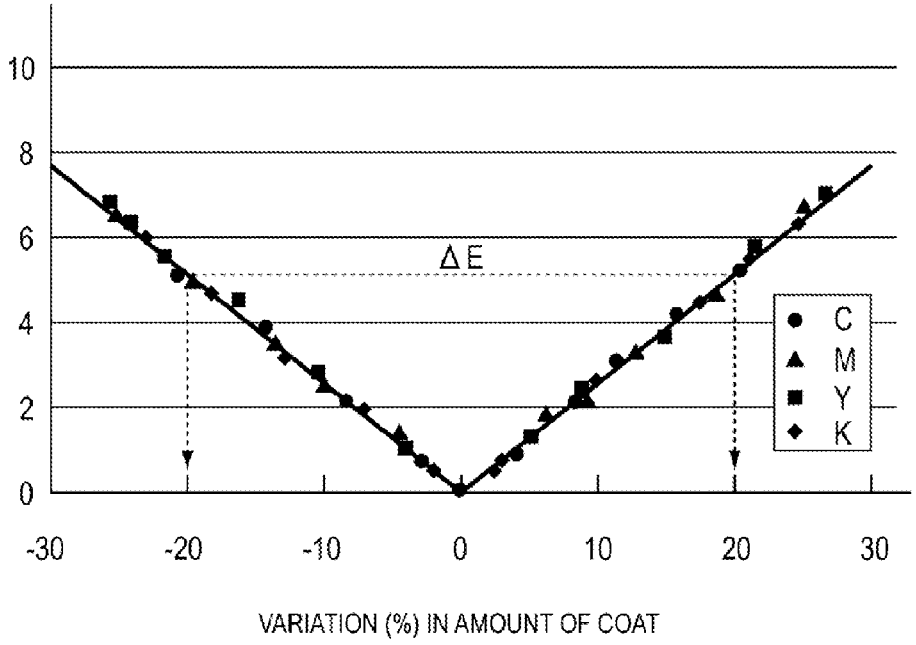
FIG. 14B is a graph illustrating the relationship between a variation in an amount of coat and a chrominance $\Delta E$.

FIGS. 14A and 14B are graphs illustrating a cumulative frequency distribution function on the surface of the toner conveying member and an integrated value thereof, and an illustration of the relationship between a variation in the amount of coat and a chrominance ΔE. First, FIG. 14A illustrates a cumulative frequency distribution function on the surface of the toner conveying member and an integrated value thereof. Specifically, FIG. 14A illustrates a cumulative frequency distribution function G(x) of x (=$S_{Dn}/S_{Tn}$) on the surface of the toner conveying member and an integrated value thereof ∫G(x)dx. Since the integrated value ∫G(x)dx is the sum of microscopic amounts of coat (m/s), the integrated value is proportional to a macroscopic amount of coat in the measurement region (that is, an image density (reflection density, Dr). That is, the integrated value can be represented by the expression of FIG. 13B.

Here, an ideal arrangement interval of the recess structures is such a degree that the toner coated in the recess structure is transferred to a sheet, and toner particles adhere to each other without any gap in the arrangement interval of the recess structures after fixing, and the sheet is covered with a toner image.

Specifically, a total volume of toner coated in the region, Dn, in the triangle, Tn, formed by three adjacent recess structures on the toner conveying member illustrated in FIG. 9B is equal to or larger than the volume of a triangular prism determined by the product of the area, $S_{Tn}$, of the triangle, Tn, and the thickness, $d_t$, of the toner layer after fixing. That is, the expression of FIG. 13C is satisfied.

A toner load amount, κ, in the recess structure can approximate to the expression of FIG. 13D because the toner particles are filled as closely as possible.

Moreover, since the thickness, $d_t$, of the toner layer after fixing can be decreased to approximately ⅓ of the toner particle diameter, $r_t$, the expression of FIG. 13D can be approximated to the expression of FIG. 13E.

When the expression of FIG. 13E is satisfied, it is possible to fix the toner coated in the three adjacent recess structures without any gap in the microscopic region (the triangle Tn). In other words, if an average percentage of recess structures per unit area of at least a toner bearing region of a developing sleeve is 55% or more, it is possible to fix the toner without any gap. Here, the recess structure means a region of which a smallest opening width, R, is equal to or larger than the toner particle diameter, $r_{t10}$, and equal to or smaller than the carrier particle diameter, $r_{c10}$, and the depth D is equal to or larger than $r_{t10}/2$.

On the other hand, it is further preferable that $S_{Dn}/S_{Tn}$ be set as follows from the perspective of structural durability. When the opening of the recess structure approximates to a circle having a radius of r and the width of a convex structure between the adjacent recess structures is S (=λ−2r), $S_{Dn}$ and $S_{Tn}$ can be represented by the expressions of FIGS. 13F and 13G. Thus, $S_{Dn}/S_{Tn}$ can be represented by the expression of FIG. 13H.

In this case, it is preferable that an aspect ratio (=S/D) of the convex structure be ¼ or more from the perspective of structural durability. Moreover, it is further preferable that $S_{Dn}/S_{Tn}$ is set to satisfy the expression of FIG. 13I since the opening width is equal to or smaller than $r_{c10}$ and the depth, D, is equal to or larger than $r_{t10}/2$.

On the other hand, it is necessary to suppress a variation Δ(∫G(x)dx) in the amount of coat on the toner conveying member to be within ±10%. FIG. 14B illustrates the relationship between the variation in the amount of coat and the chrominance ΔE. Specifically, FIG. 14B is a diagram illustrating the relationship between the variation in the amount of coat and the chrominance ΔE when 0.3 mg/cm$^2$ of toner particles of cyan (C), magenta (M), yellow (Y), and black (K) are coated on the toner conveying member.

In order to suppress the chrominance ΔE within the surface for all toner particles of the respective colors to be within 5, the variation Δ in the amount of coat needs to be within ±10%. More preferably, the variation Δ in the amount of coat is within ±6% in order to suppress the chrominance ΔE within the surface to be within 3. As described above, since the amount of coat is proportional to the integrated value ∫G(x)dx, it is necessary that the variation Δ of the integrated value ∫G(x)dx on the toner conveying member be within ±10%. More preferably, the variation Δ in the integrated value ∫G(x) on the toner conveying member is within ±6%. A method of measuring the variation will be described later.

(Coat Comparison) A developer (TD ratio 12%) composed of a carrier, A, and a toner, TA, that is negatively charged in relation to the carrier, A, and a toner conveying member that is positively charged in relation to the carrier, A, are prepared.

A plurality of toner conveying members of which the surface has a honey comb-shaped structure is prepared in which an opening width R is 6.5 μm, one side "a" of the opening is 4.3 μm, and the depth, D, is 3.5 μm, and in which the length λ (7.5 μm, 8.5 μm, 10 μm, 11.5 μm, and 12.5 μm) of the recess structure is varied.

The recess structures on the surfaces of the toner conveying members are measured (see the recess structure measuring method) and the distribution of $S_{Dn}/S_{Tn}$ on the surface of the toner conveying member is calculated. A method of measuring $S_{Dn}/S_{Tn}$ distribution will be described later.

Figure 15A:
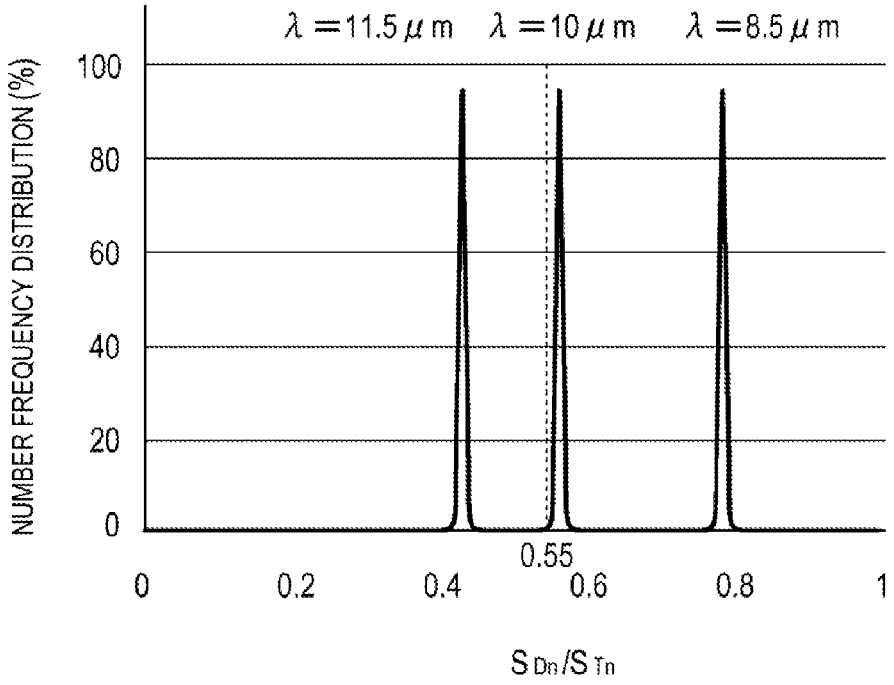
FIG. 15A is a graph illustrating a number frequency distribution of $S_{Dn}/S_{Tn}$ on the surface of the toner conveying member.
Figure 15B:
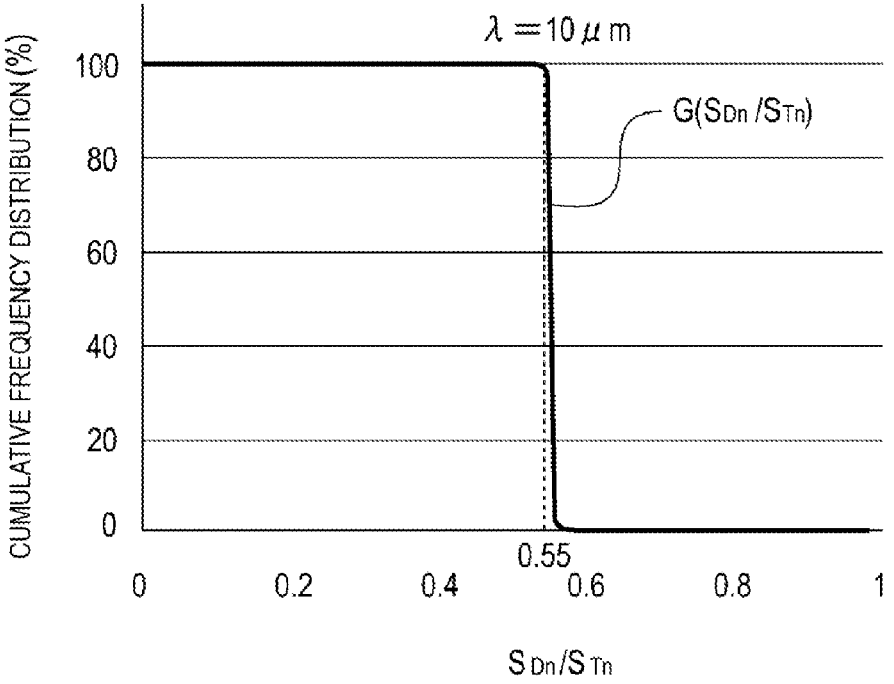
FIG. 15B is a graph illustrating a cumulative frequency distribution.

FIGS. 15A and 15B are graphs illustrating a number frequency distribution and a cumulative frequency distribution of $S_{Dn}/S_{Tn}$ on the surface of the toner conveying member. First, FIG. 15A illustrates a number frequency distribution of $S_{Dn}/S_{Tn}$ on the surface of the toner conveying member. Specifically, FIG. 15A illustrates a number frequency distribution of $S_{Dn}/S_{Tn}$ on the surface of the toner conveying members in which λ=8.5 μm, 10 μm, and 11.5 μm.

FIG. 15B illustrates a cumulative frequency distribution of $S_{Dn}/S_{Tn}$ on the surface of the toner conveying member. Specifically, FIG. 15B illustrates a cumulative frequency distribution of $S_{Dn}/S_{Tn}$ on the surface of the toner conveying member in which λ=10 μm.

FIGS. 16A and 16B are tables illustrating ∫G(x)dx and a density evaluation result of the respective toner conveying members and a variation Δ∫G(x)dx and a uniformity evaluation result. A method of calculating ∫G(x)dx and Δ∫G(x)dx will be described later.

The density evaluation results are obtained by coating toner on the toner conveying members, performing developing and transferring sequentially, fixing a toner image on the coated sheet, and conducting a density evaluation.

The density evaluation results are obtained by measuring the reflection density, Dr, on the coated sheet using a reflection density meter, and "O" is assigned when the measured density falls within an allowable reflection density (CMY: Dr≤1.3, K: Dr≤1.5) and "X" is assigned when the relation is not satisfied. The uniformity evaluation results are obtained by measuring ΔE on the coated sheet after fixing, and "O" is assigned when the measured value falls within an allowable (ΔE≤5) and "X" is assigned when the relation is not satisfied.

Similarly, a plurality of toner conveying members in which the opening width R is 30 μm, one side "a" of the opening is 19.5 μm, and the depth D is 3.5 μm, and in which the cycle λ (32.5 μm, 35 μm, 40 μm, 45 μm, and 50 μm) of the recess structure is varied is prepared and the examination is conducted.

As described above, the arrangement of the recess structure on the toner conveying member is limited as follows regardless of the recess structure. The integrated value $\int G(x)dx$ of the cumulative frequency distribution function G(x) of x ($=S_{Dn}/S_{Tn}$) on the surface of the toner conveying member is 55 or more and the variation $\Delta(\int G(x)dx$ is ±10%. That is, an average percentage of the recess structures per unit area of a toner coated region of the developing sleeve is 55% or more. Moreover, it is preferable that a variation in the percentage of the recess structures per unit area is within ±10%, and more preferably within ±6%.

Figure 17:
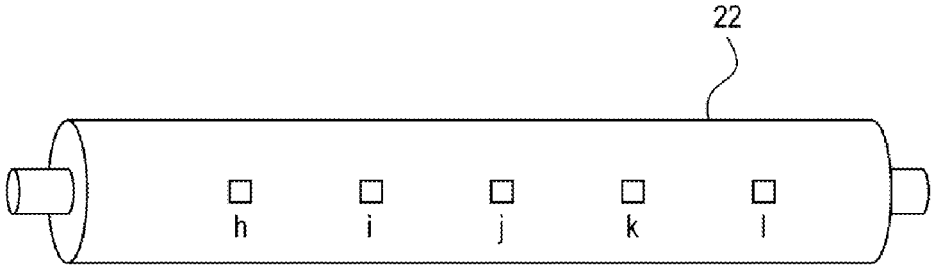
FIG. 17 is a diagram illustrating the structure of a toner bearing member.

($S_{Dn}/S_{Tn}$ Distribution Measuring Method) A method of measuring $S_{Dn}/S_{Tn}$ distribution will be described. FIG. 17 is a diagram illustrating the structure of a toner bearing member. Optional five surface locations (h, i, j, k, and l) arranged in the axial direction are cut and the recess structure on the surface of the toner conveying member is measured. In this case, the triangle, Tn, and the region, Dn, present on the surface of 100 μm×100 μm at each observation point are measured (see FIG. 9B).

The $S_{Dn}/S_{Tn}$ is calculated in the five surface locations and a number frequency distribution of $S_{Dn}/S_{Tn}$ is obtained. In this case, $S_{Dn}/S_{Tn}$ is rounded off to two decimal places. An example of the number frequency distribution of $S_{Dn}/S_{Tn}$ obtained is illustrated in FIG. 15A. Subsequently, $S_{Dn}/S_{Tn}$ is accumulated from its largest value to calculate the cumulative frequency distribution. An example of the cumulative frequency distribution of $S_{Dn}/S_{Tn}$ is illustrated in FIG. 15B.

(Method of Measuring Percentage of Recess Structure) The percentage of a recess structure (a region in which a smallest opening width R is equal to or larger than the toner particle diameter $r_{t10}$ and equal to or smaller than the carrier particle diameter $r_{c10}$, and the depth D is equal to or larger than $r_{t10}/2$) in a toner coated region of a developing sleeve is obtained in the following manner. That is, arbitrary five surface locations (h, i, j, k, and l) are cut and the recess structure on the surface of the toner conveying member is measured. In this case, the percentage of recess structures present on the surface of 100 μm×100 μm at the respective observation points is obtained, and an average thereof is used as the percentage of the recess structure on the surface of the developing sleeve.

(Method of Calculating $\int G(x)$ and $\Delta(\int(G(x)dx))$ A method of calculating the integrated value $\int G(x)$ of the cumulative frequency distribution function will be described. The cumulative frequency distribution functions G(x) at the five surface locations are integrated using a spreadsheet software (for example, Microsoft Excel).

Figure 18:
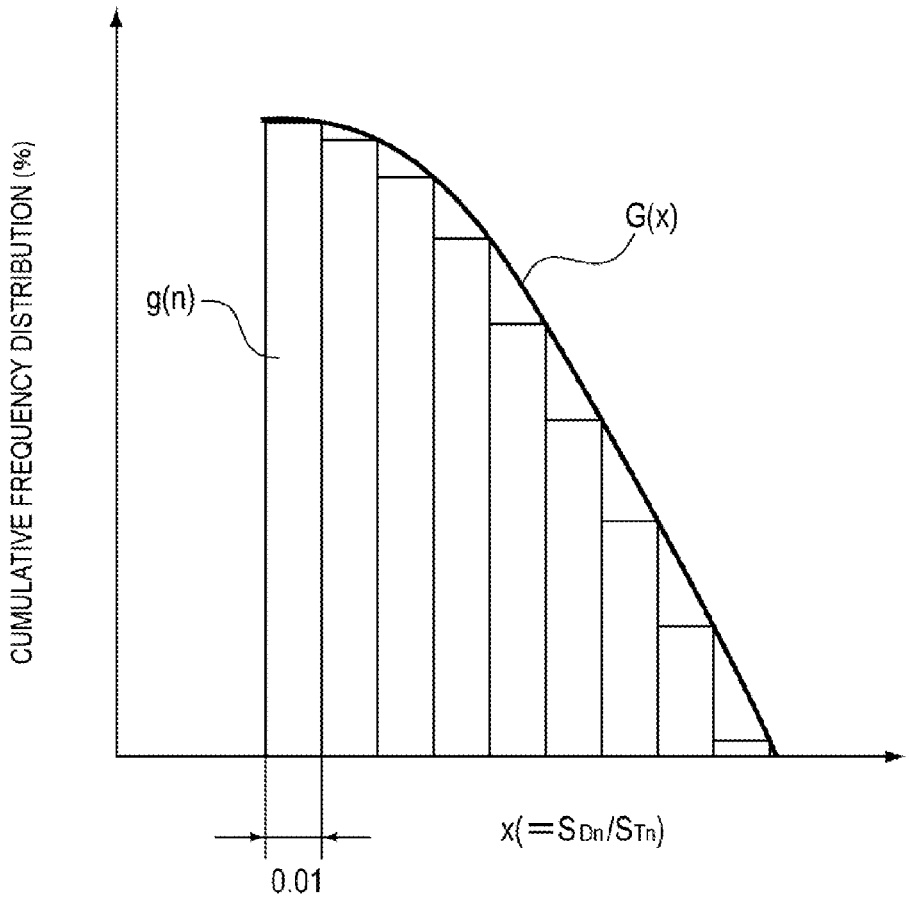
FIG. 18 is a graph illustrating a specific integrating method of the cumulative frequency distribution.

FIG. 18 is a graph illustrating a specific integration method of the cumulative frequency distribution. The cumulative frequency distribution approximate as a sum of rectangles g(n) in which the width of $S_{Dn}/S_{Tn}$ is 0.01.

Then, the integrated value can be represented by the expression of FIG. 19A. FIGS. 19A and 19B are diagrams illustrating the expressions used in the method of calculating $\int G(x)$ and $\Delta(\int G(x)dx)$.

A method of calculating the variation $\Delta(\int G(x)dx)$ will be described. A largest value $\int G_{max}(x)$ and a smallest value $\int G_{min}(x)$ of the integrated values $\int Gh(x)$, $\int Gi(x)$, $\int Gj(x)$, $\int Gk(x)$, and $\int Gl(x)$ of the respective cumulative frequency distribution functions on the five surface locations are obtained, and the variation is calculated according to the expression illustrated in FIG. 19B. Moreover, the variation $\Delta\int G(x)dx$ may be measured in a simplified manner as below.

That is, recess structures (a region in which a smallest opening width R is equal to or larger than the toner particle diameter $r_{t10}$ and equal to or smaller than the carrier particle diameter $r_{c10}$ and the depth D is equal to or larger than $r_{t10}/2$) occupying each of arbitrary surface locations (h, i, j, k, and l) are calculated. Moreover, the percentage of the recess structures present on the surface of 100 μm×100 μm at each observation point is obtained. A smallest value MN and a largest value MX of the percentage are obtained, and a percentage (=±Δ/Av×100%) of a variation Δ(=Mx−Av) from the average Av (=(MN+MX)/2) with respect to the average value Av may be used as the variation.

Second Embodiment

FIGS. 20A to 20C and FIG. 21 are diagrams illustrating a recess structure on a toner conveying member according to a second embodiment. FIGS. 22A to 22C are diagrams illustrating expressions used in a description of the second embodiment. Configurations approximately the same as those described above will be denoted by the same reference numerals, and a description thereof will not be provided.

Figure 20A:
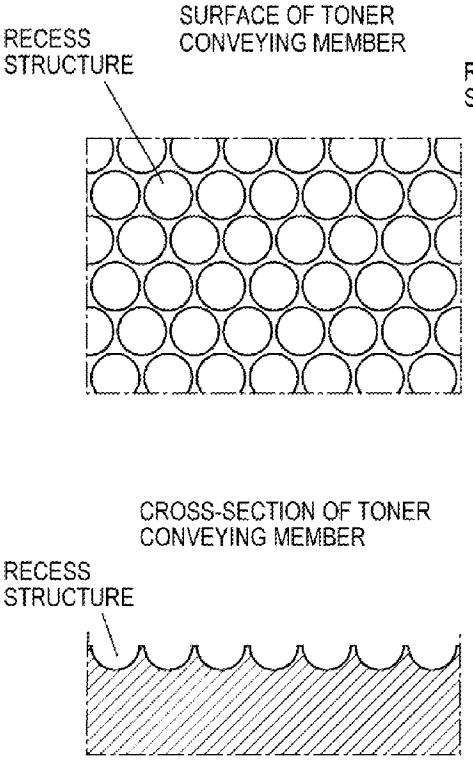
FIG. 20A is a diagram illustrating a recess structure on a toner conveying member according to the second embodiment.
Figure 20B:
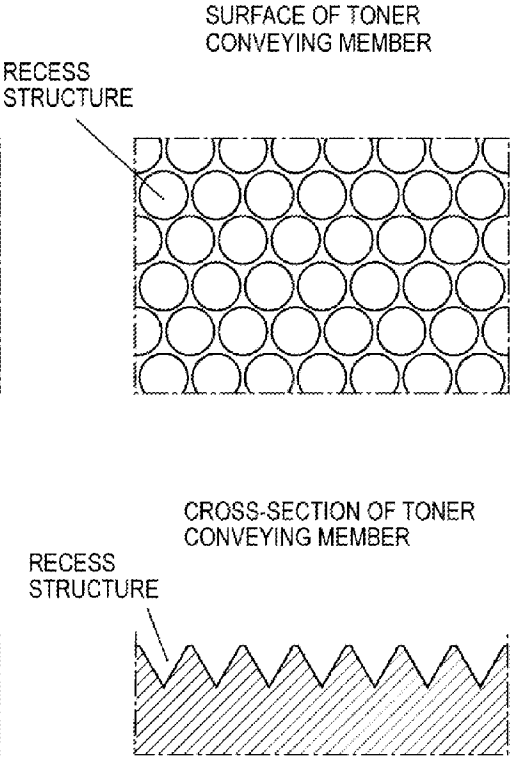
FIG. 20B is a diagram illustrating a recess structure on a toner conveying member according to the second embodiment.
Figure 20C:
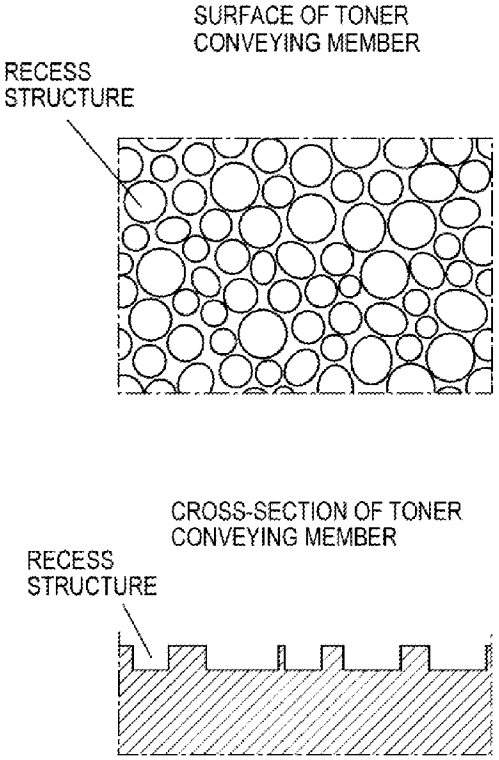
FIG. 20C is a diagram illustrating a recess structure on a toner conveying member according to the second embodiment.

FIG. 20A illustrates a recess structure having a lens shape. Due to the lens shape, since the recess structure has a depth distribution, it is possible to reduce the particle diameter selectivity of the coated toner. Moreover, a V-groove shape as illustrated in FIG. 20B provides the same effects. Moreover, FIG. 20C illustrates recess structures having different opening shapes and different opening widths, which are arranged in a non-uniform manner. Since the recess structures are arranged non-uniformly, it is possible to prevent moire when colors are superimposed on each other.

Figure 21:
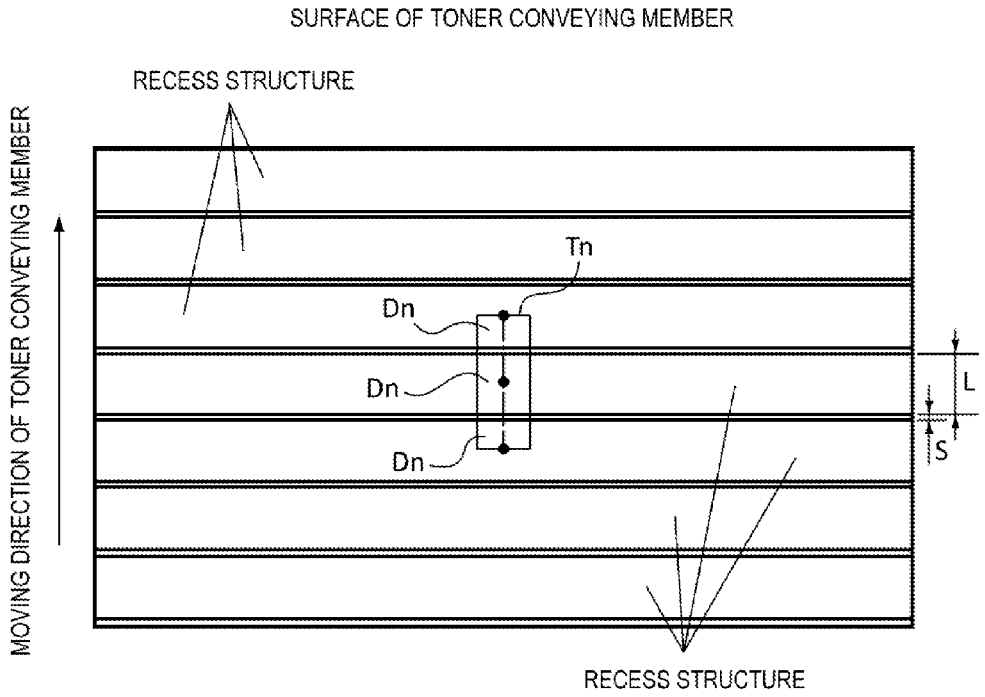
FIG. 21 is a diagram illustrating a recess structure on a toner conveying member according to the second embodiment.

FIG. 21 illustrates recess structures arranged in a line on a toner conveying member. In the present embodiment, although the recess structures are arranged in a vertical direction with respect to a moving direction of the toner conveying member, the arrangement direction may be inclined with respect to the moving direction. Moreover, the shape of the recess structure is not limited to a rectangular shape, a lens shape, a V-groove shape, or the like. When the recess structures are arranged in a line, the recess structures may be arranged so that the centers are arranged in a straight line as in the drawing.

In such a case, as illustrated in the drawing, a quadrangle formed by straight lines parallel to the straight line connecting the centers and straight lines orthogonal to the straight line is defined as Tn, and a region in which the openings of the recess structures overlap the quadrangle, Tn, is defined as Dn.

In order for the toner coated on the three adjacent recess structures to be fixed without any gap to the microscopic region (Tn depicted by the quadrangle), the expression of FIG. 22A needs to be satisfied. In this case, if a line width (a smallest opening width of the recess structure) is L and a space width (width of a convex structure) is S, $S_{Dn}/S_{Tn}$ is represented by the expression of FIG. 22B.

It is preferable that an aspect ratio (=S/D) of the convex structure be ¼ or more from the perspective of structural durability. Moreover, it is further preferable that the aspect ratio satisfy the expression of FIG. 22C since the line width L is equal to or smaller than $r_{c10}$, the depth D is equal to or larger than $r_{t10}/2$.

Moreover, in this case, it is necessary that the line width L is equal to or smaller than the smallest opening width, R, described in the first embodiment. That is, the line-shaped recess structure is a region in which the line width is equal to or larger than the toner particle diameter, $r_{t10}$, and equal to or smaller than the carrier particle diameter, $r_{c10}$, and the depth, D, is equal to or larger than $r_{t10}/2$.

As described above, the object of the present invention can be attained if the recess structure satisfies the conditions of the above embodiments regardless of the opening of the recess structure and the cross-sectional shape thereof.

Third Embodiment

Figure 23:
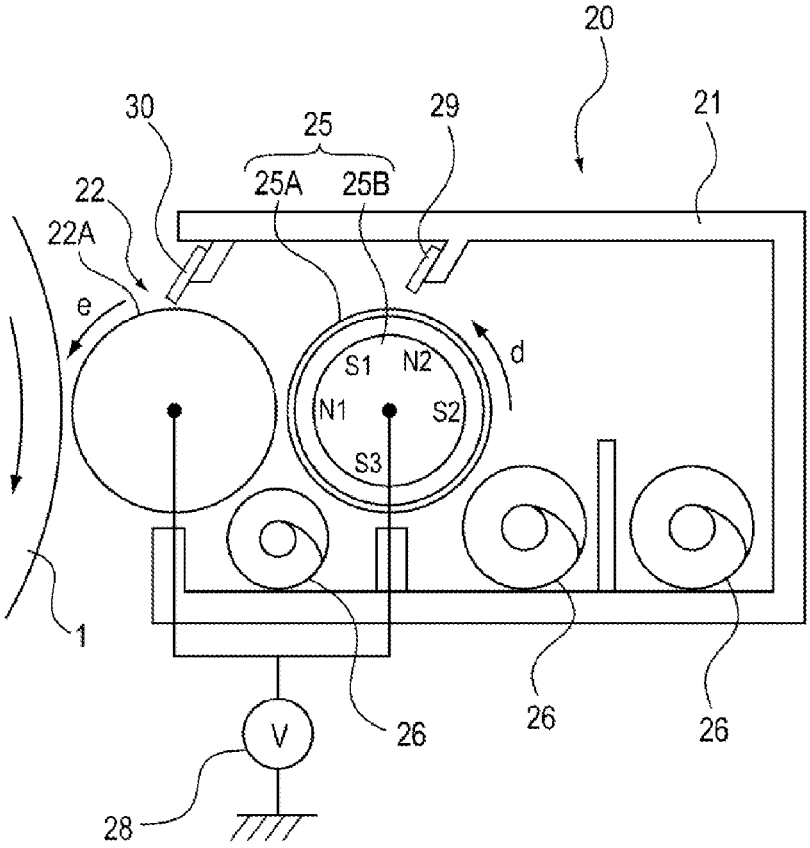
FIG. 23 is a diagram illustrating a schematic configuration of a developing device according to a third embodiment.

FIG. 23 is a diagram illustrating a schematic configuration of a developing device according to a third embodiment. Configurations approximately the same as those described above will be denoted by the same reference numerals, and a description thereof will not be provided.

A developing device 20 according to the present embodiment includes a developing container 21 that stores a developer including a non-magnetic toner and a magnetic carrier, and a mixing and supplying member 26 that mixes the developer and supplies the same to a developer supplying and collecting member 25.

The developer supplying and collecting member 25 includes a developer conveying member 25A that is rotatable in the direction indicated by an arrow "d" in the drawing and a permanent magnet 25B that is fixedly disposed therein. A toner bearing member 22 including a toner conveying member 22A that is rotatable in the direction indicated by an arrow "e" in the drawing is disposed at a position that the developer makes contact with so as to face the developer supplying and collecting member 25.

The developer supplying and collecting member 25 is arranged on an upstream side of a scraping portion in which the born developer is scraped in the moving direction of the developer conveying member 25A. Moreover, the developer supplying and collecting member 25 is arranged so as to have a facing portion that faces the toner bearing member 22 at a position on the downstream side of a supply portion in which the developer is supplied by the mixing and supplying member 26.

In the present embodiment, although the developer conveying member 25A and the toner conveying member 22A rotate in the same direction, the members may rotate in opposite directions. However, it is preferable that the two members rotate at different rotation speeds so as to increase the contact frequency between the toner conveying member 22A and the developer.

In the present embodiment, the triboelectric series of the toner, the magnetic carrier, and the surface of the toner conveying member 22A are the same as those of the first embodiment. That is, the triboelectric series are arranged so that the magnetic carrier is between the toner and the surface of the toner bearing member, and the surface has a plurality of recess structures in which a smallest opening width R is equal to or larger than $r_{t10}$ and equal to or smaller than $r_{c10}$, and a depth D is equal to or larger than $r_{t10}/2$.

In the present embodiment, although the toner conveying member 22A used is a roller formed from aluminum, the toner conveying member 22A is not limited to this. The recess structure on the toner conveying member 22A can be formed by laser edging.

On the other hand, the triboelectric series of the developer conveying member 25A is located closer to the toner than the toner conveying member 22A. This is to prevent a state in which, when toner adheres and fuses to the developer conveying member 25A, the developer bearing capability of the developer supplying and collecting member 25 decreases, and the toner supply capability deteriorates and the carrier leaks.

In the present embodiment, although a roller in which a fluorocarbon resin is coated on aluminum is used as the developer conveying member 25A, the developer conveying member 25A is not limited to this.

A developer regulating member 29 is disposed above the developer supplying and collecting member 25 so as to regulate the amount of developer on the developer supplying and collecting member 25. Moreover, a scatter preventing sheet 30 is provided above the toner bearing member 22 in order to prevent scattering of toner outside the developing device.

Steps of coating toner on the toner conveying member 22A will be described. The developer supplied to the developer supplying and collecting member 25 by the mixing and supplying member 26 is conveyed in the direction indicated by an arrow "d" in the drawing with a rotation of the developer conveying member 25A and the magnetic force exerted by the magnetic field created by the permanent magnet 25B.

After the amount of developer is regulated by the developer regulating member 29, the developer is supplied to the facing portion in which the developer faces the toner conveying member 22A with a rotation of the developer conveying member 25A and the magnetic force exerted by the magnetic field between the magnetic poles S1 and N1.

When the developer supplied makes contact with the toner conveying member 22A, only the toner is coated on the toner conveying member 22A. On the other hand, the developer excluding the coated toner is collected to the developer conveying member 25A with a rotation of the developer conveying member 25A and the magnetic force exerted by the magnetic field between the magnetic poles N1 and S3. Moreover, the developer is scraped from the developer conveying member 25A by the magnetic force exerted by the magnetic field between the adjacent same-polarity magnetic poles S3 and S2 and is eventually conveyed into the developing container 21.

The toner coated on the toner conveying member 22A is conveyed up to the developing portion by the toner conveying member 22A. An electric field application portion 28 applies a developing bias voltage between the toner conveying member 22A and the photosensitive member 1. Moreover, the toner bearing member 22 and the core metals of the developer supplying and collecting member 25 are electrically connected so as to be at the same potential. The toner conveyed to the developing portion is developed by the developing bias voltage.

In the developing device according to the present embodiment, the toner bearing member 22 is provided to be independent from the developer supplying and collecting member 25 that supplies and collects the developer to and from the toner bearing member 22. Due to this, even when the amount of toner consumed increases, the developer supply capability decreases, and the developer deteriorates so that the amount of coat decreases, it is possible to suppress a variation in the amount of coat without affecting the other configurations by controlling the rotating speed of the developer conveying member 25A.

Fourth Embodiment

Figure 24:
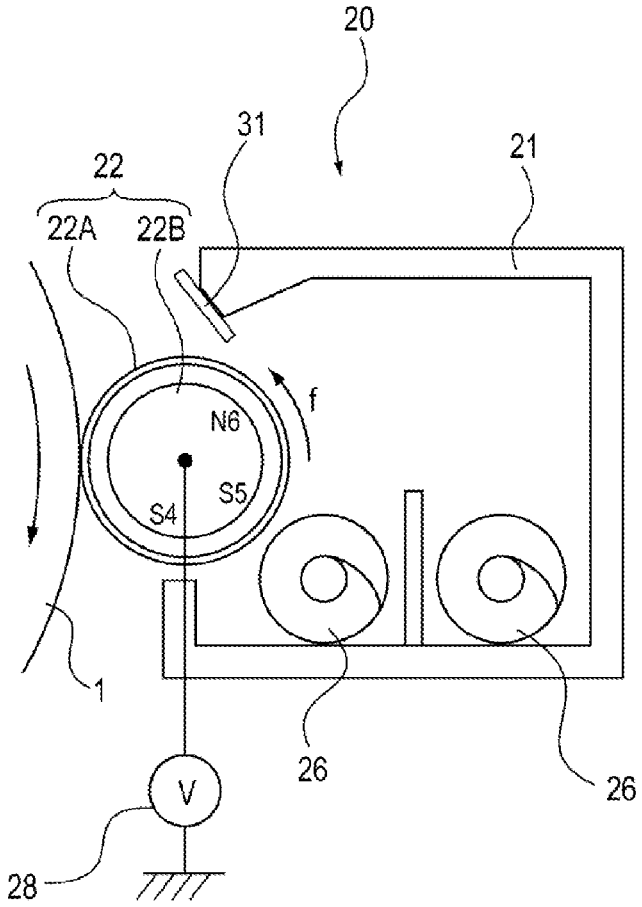
FIG. 24 is a diagram illustrating a schematic configuration of a developing device according to a fourth embodiment.

FIG. 24 is a diagram illustrating a schematic configuration of a developing device according to a fourth embodiment. Configurations approximately the same as those described above will be denoted by the same reference numerals, and a description thereof will not be provided.

A developing device 20 according to the present embodiment includes a developing container 21 that stores a developer including a non-magnetic toner and a magnetic carrier, and a mixing and supplying member 26 that mixes the developer and supplies the same to a toner bearing member 22.

The toner bearing member 22 includes a toner conveying member 22A that is rotatable in the direction indicated by an arrow "f" and a permanent magnet 22B that is fixedly disposed therein.

In the present embodiment, the triboelectric series of the toner, the magnetic carrier, and the surface of the toner conveying member 22A are the same as those of the first embodiment. That is, the triboelectric series are arranged so that the magnetic carrier is between the toner and the surface of the toner conveying member 22A, and the surface has a plurality of recess structures in which a smallest opening width R is equal to or larger than $r_{t10}$ and equal to or smaller than $r_{c10}$, and a depth D is equal to or larger than $r_{t10}/2$.

In the present embodiment, the toner conveying member 22A has a configuration in which an elastic layer 22*a* is coated on a cylindrical member of which the base 22*b* is formed of a metal material (see FIG. 3B), a photo-curable resin is applied thereon, and a recess structure is formed according to a photo-nanoimprinting method. A magnetic member 31 that is fixedly disposed is provided above the toner bearing member 22.

Steps of coating toner on the toner conveying member 22A of the developing device 20 according to the present embodiment will be described.

The developer supplied to the toner bearing member 22 by the mixing and supplying member 26 is conveyed in the direction indicated by an arrow "f" with a rotation of the toner conveying member 22A and the magnetic force exerted by the magnetic field created by the permanent magnet 22B. The developer conveyed is confined in the facing portion, in which the magnetic member 31 and the toner bearing member 22 face, by the magnetic force formed by the magnetic field created by the cooperation of the magnetic member 31 and the permanent magnet 22B and is eventually dropped in the developing container 21 due to gravity.

On the other hand, the toner making contact with and being coated on the toner conveying member 22A is conveyed up to the developing portion while bypassing the facing portion since the toner is not confined by the magnetic force. An electric field application portion 28 applies a developing bias voltage between the toner conveying member 22A and the photosensitive member 1. The toner conveyed to the developing portion is developed by the developing bias voltage.

Since the developing device 20 according to the present embodiment has a simple configuration, it is possible to cope with downsizing of the developing device 20.

Fifth Embodiment

Figure 25:
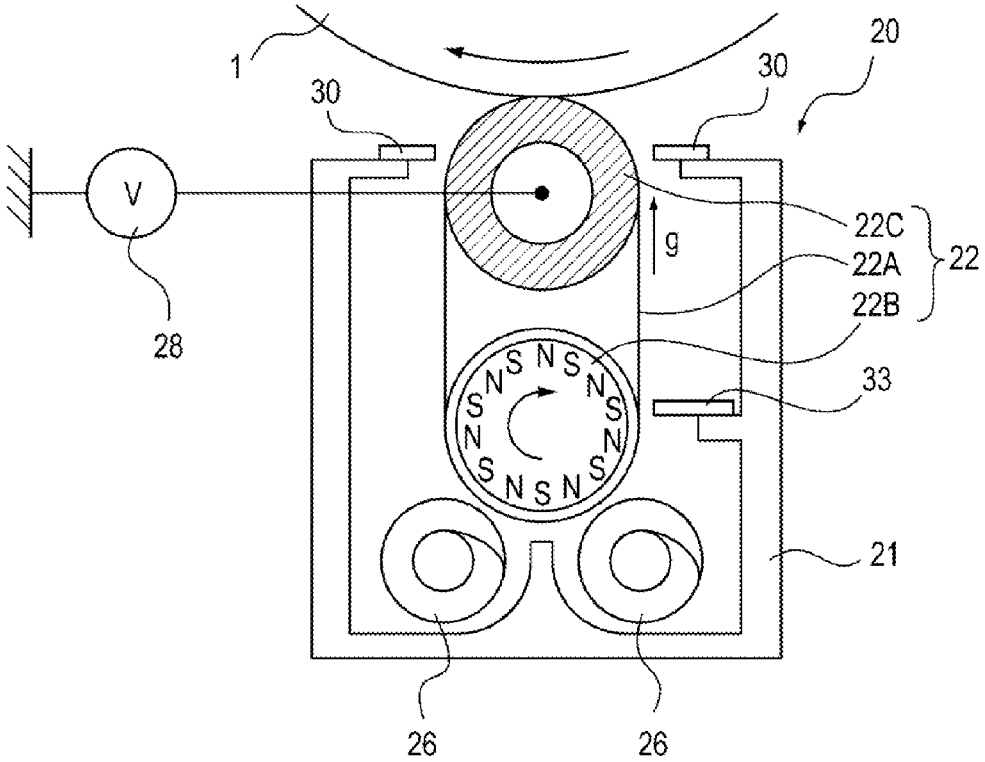
FIG. 25 is a diagram illustrating a schematic configuration of a developing device according to a fifth embodiment.
Figure 26A:
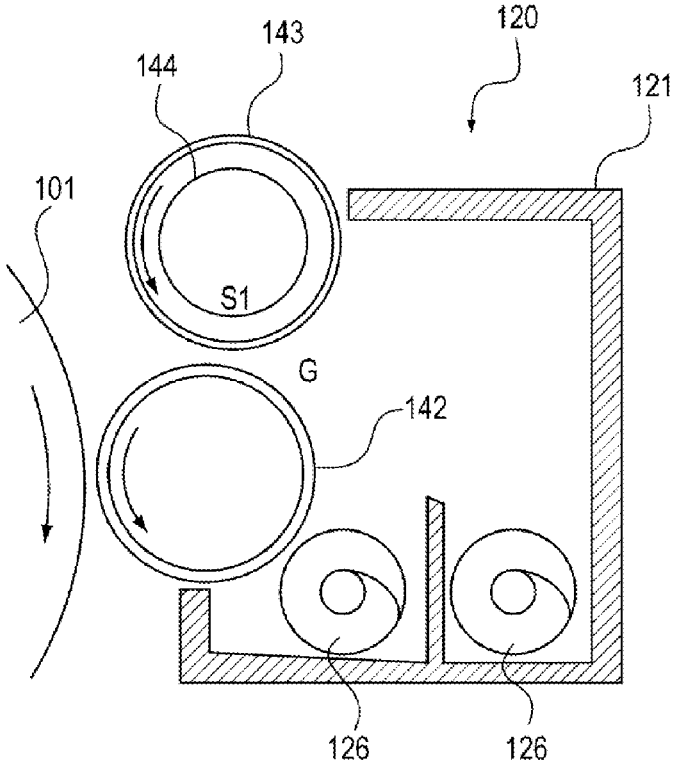
FIG. 26A PRIOR ART
FIG. 26A is a diagram illustrating a schematic configuration of a developing device of the related art.
Figure 26B:
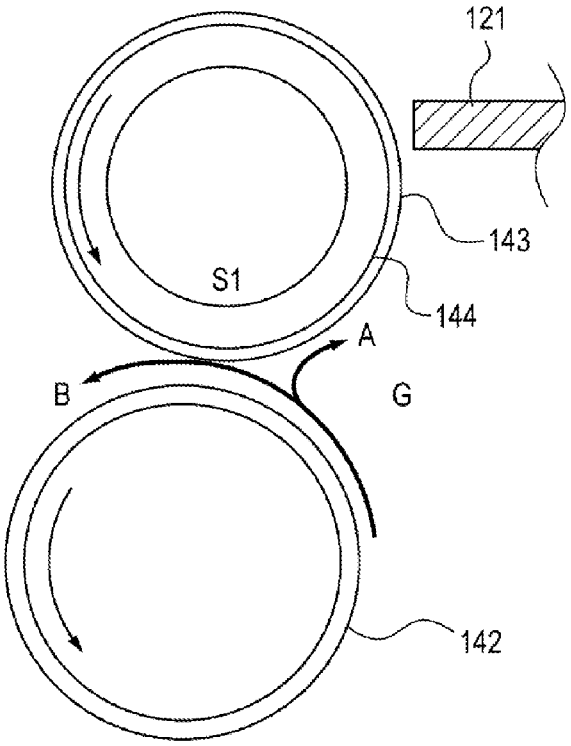
FIG. 26B PRIOR ART
FIG. 26B is a diagram illustrating a schematic configuration of a developing device of the related art.
Figure 27A:
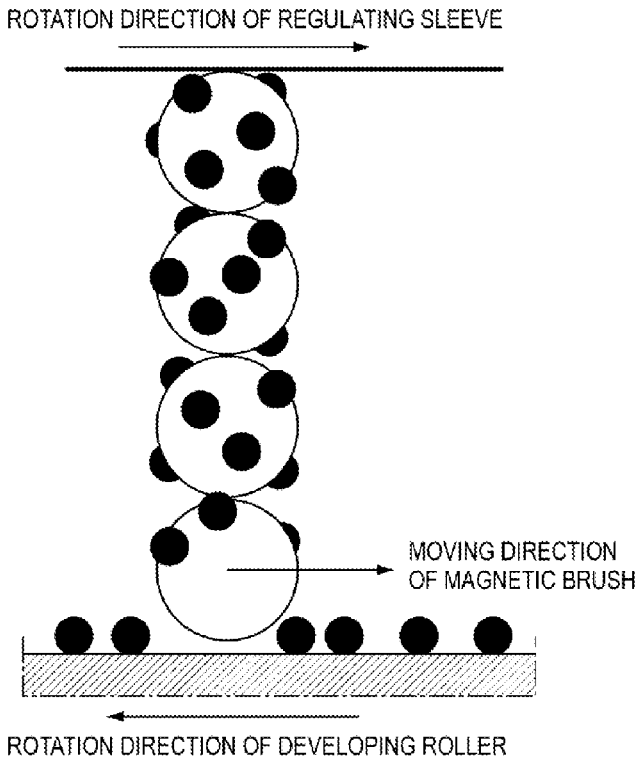
FIG. 27A PRIOR ART
FIG. 27A is a diagram for illustrating a problem associated with the related art.
Figure 27B:
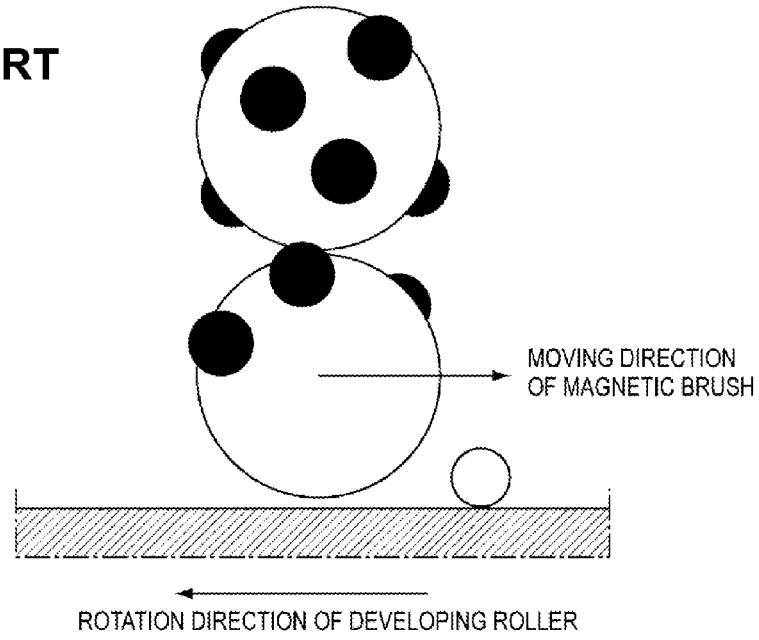
FIG. 27B PRIOR ART
FIG. 27B is a diagram for illustrating a problem associated with the related art.

FIG. 25 is a diagram illustrating a schematic configuration of a developing device according to a fifth embodiment. Configurations approximately the same as those described above will be denoted by the same reference numerals, and description thereof will not be provided.

A developing device 20 according to the present embodiment includes a developing container 21 that stores a developer including a non-magnetic toner and a magnetic carrier, and a mixing and supplying member 26 that mixes the developer and supplies the same to a toner bearing member 22.

The toner bearing member 22 includes an endless belt-shaped toner conveying member 22A that is rotatable in the direction indicated by "g" in the drawing, a permanent magnet 22B that is rotatably disposed therein, and an elastic member 22C obtained by coating an elastic layer around a cylindrical member of which the base is formed from a metal material.

In the present embodiment, the triboelectric series of the toner, the magnetic carrier, and the surface of the toner conveying member 22A are the same as those of the first embodiment. That is, the triboelectric series are arranged so that the magnetic carrier is between the toner and the surface of the toner conveying member 22A, and the surface has a plurality of recess structures in which a smallest opening width R is equal to or larger than $r_{t10}$ and equal to or smaller than $r_{c10}$, and a depth D is equal to or larger than $r_{t10}/2$.

In the present embodiment, although a polyimide film is used as the toner conveying member 22A and the recess structure is formed according to a thermal nanoimprinting method, the present invention is not limited to this.

On the other hand, a regulating member 33 is disposed so as to substantially face the rotatable permanent magnet 22B. The regulating member 33 is preferably formed from a metal material such as iron having high magnetic permeability.

A scatter preventing sheet 30 is provided in the opening of the developing container in order to prevent scattering of toner outside the developing device.

Steps of coating toner on the toner conveying member 22A will be described.

The developer supplied to the toner bearing member 22 by the mixing and supplying member 26 is conveyed in the direction indicated by an arrow "g" in the drawing with a rotation of the toner conveying member 22A and the magnetic force exerted by the magnetic field created by the rotation of the permanent magnet 22B.

The developer conveyed is confined in the facing portion, in which the regulating member 33 and the toner bearing member 22 face, by the magnetic force formed by the magnetic field created by the cooperation of the regulating member 33 and the permanent magnet 22B and is eventually dropped in the developing container 21 due to gravity.

On the other hand, the toner making contact with and being coated on the toner conveying member is conveyed up to the developing portion while bypassing the facing portion since the toner is not confined by the magnetic force. An electric field application portion 28 applies a developing bias voltage between the toner conveying member 22A and the photosensitive member 1. The toner conveyed to the developing portion is developed by the developing bias voltage.

In the developing device 20 of the present embodiment, the permanent magnet 22B disposed inside the toner bearing member 22 rotates whereby the magnetic brush is conveyed while rotating around the conveying member. Due to this, it is possible to increase the contact frequency between the toner and the toner conveying member 22A in a short conveying distance and time. Moreover, it is possible to suppress a variation in the amount of coat without affecting other configurations by controlling the rotation speed of the permanent magnet 22B.

With the above configuration, it is possible to coat a uniform toner layer stably on a toner bearing member in a configuration where the toner layer is coated on the toner bearing member by allowing a two-component developer to make contact with the surface.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-270394, filed Dec. 11, 2012, which is hereby incorporated by reference herein in its entirety.

What is claimed is:

1. A developing device comprising:

a developing container which stores a developer including a non-magnetic toner and a magnetic carrier;

a toner bearing member which bears the toner and conveys the toner to a developing portion formed between the toner bearing member and an image bearing member on which an electrostatic latent image is formed; and a separating portion which is disposed on an upstream side of the developing portion in a developer conveying direction so as to separate the toner from the developer so that the toner is supplied to the toner bearing member, wherein a surface of the toner bearing member includes a plurality of recess structures in which a smallest opening width R is equal to or larger than $r_{t10}$ and equal to or smaller than $r_{c10}$, and a depth D is equal to or larger than $r_{t10}/2$, where $r_{t10}$ is a particle diameter at which the cumulative distribution in a toner granularity distribution is 10%, and $r_{c10}$ is a particle diameter at which the cumulative distribution in a carrier granularity distribution is 10%; and each percentage of the recess structures per unit area in any area of a toner bearing region of the toner bearing member is equal to or larger than 55%.

2. The developing device according to claim 1, wherein a variation in each percentage of the recess structures per unit area in the toner bearing region is within ±10% of an average of the percentages in the toner bearing region of the toner bearing member.

3. The developing device according to claim 1, wherein a triboelectric series of the surface of the toner bearing member, the toner, and the magnetic carrier are arranged so that the magnetic carrier is located between the toner and the surface of the toner bearing member.

4. The developing device according to claim 1, wherein the toner bearing member includes a toner conveying member which bears and conveys the toner and a plurality of permanent magnets which are fixedly disposed inside the toner conveying member, the developing device further comprising:

a mixing and supplying member which mixes and supplies the developer inside the developing container; and a developer collecting member including a rotatable developer conveying member which includes a plurality of permanent magnets fixedly disposed therein, the developer collecting member is arranged on an upstream side of the developing portion in the moving direction of the toner conveying member and on a downstream side of a supply portion to which the developer is supplied by the mixing and supplying member, and the permanent magnets disposed inside the toner conveying member and the permanent magnets disposed inside the developer collecting member form a magnetic field in cooperation.

5. The developing device according to claim 1, further comprising:

a mixing and supplying member which mixes and supplies the developer inside the developing container; and a developer supplying and collecting member which includes a rotatable developer conveying member and a plurality of permanent magnets fixedly disposed inside the developer conveying member, the developer supplying and collecting member being supplied with the developer from the mixing and supplying member and collecting the developer from the toner bearing member, wherein the developer supplying and collecting member is arranged on an upstream side of a scraping portion in which the born developer is scraped in the moving direction of the developer conveying member and is arranged so as to have a facing portion that faces the toner bearing member at a position on a downstream side of a supply portion in which the developer is supplied by the mixing and supplying member.

6. The developing device according to claim 1, wherein the toner bearing member includes a toner conveying member which bears and conveys the toner and a plurality of permanent magnets that are fixedly disposed inside the toner conveying member, the developing device further comprising:

a magnetic member which is fixedly disposed at a position so that the magnetic member faces the toner bearing member; and a mixing and supplying member which mixes and supplies the developer inside the developing container, wherein the magnetic member is disposed on an upstream side of the developing portion in the moving direction of the toner conveying member and a downstream side of a supply portion in which the developer is supplied to the toner conveying member by the mixing and supplying member, and the permanent magnets and the magnetic member disposed in the toner conveying member form a magnetic field in cooperation.

7. The developing device according to claim 1, wherein the toner bearing member includes an endless belt-shaped toner conveying member which bears and conveys the toner and a rotatable permanent magnet disposed inside the toner conveying member, the developing device further comprising:

a mixing and supplying member which mixes and supplies the developer inside the developing container; and a regulating member fixedly disposed at a position that the regulating member faces the permanent magnet with the toner conveying member interposed, wherein the regulating member is disposed on an upstream side of the developing portion in the moving direction of the toner conveying member and on a downstream side of a supply portion in which the developer is supplied from the mixing and supplying member, and the permanent magnet and the regulating member disposed inside the toner conveying member form a magnetic field in cooperation.

8. The developing device according to claim 1, wherein the toner bearing member is formed of an elastic or flexible member and is disposed to make contact with the image bearing member.

9. An image forming apparatus comprising:

an image bearing member; and the developing device according to claim 1 which supplies the toner to an electrostatic latent image formed on the image bearing member to visualize the electrostatic latent image.

* * * * *